US007287842B2

(12) United States Patent
Aruga

(10) Patent No.: US 7,287,842 B2
(45) Date of Patent: Oct. 30, 2007

(54) PRESSURIZING PUMP DEVICE, LIQUID EJECTION APPARATUS AND METHOD OF CONTROLLING PRESSURIZING PUMP

(75) Inventor: Yoshiharu Aruga, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 377 days.

(21) Appl. No.: 11/101,644

(22) Filed: Apr. 8, 2005

(65) Prior Publication Data

US 2005/0248634 A1 Nov. 10, 2005

(30) Foreign Application Priority Data

Apr. 9, 2004 (JP) ..... P. 2004-115974
Apr. 9, 2004 (JP) ..... P. 2004-115975
Apr. 13, 2004 (JP) ..... P2004-117772

(51) Int. Cl.
*B41J 2/17* (2006.01)
*F04B 19/24* (2006.01)

(52) U.S. Cl. ..... 347/84; 417/52

(58) Field of Classification Search ..... 347/5, 347/7, 19, 84, 85; 303/3, 115.5; 417/38, 417/52, 375, 405

See application file for complete search history.

(56) References Cited

U.S. PATENT DOCUMENTS 3,932,067 A * 1/1976 Ball et al. ..... 417/339
4,336,000 A * 6/1982 Jorgensen et al. ..... 417/53
4,558,326 A * 12/1985 Kimura et al. ..... 347/30
6,030,074 A 2/2000 Barinaga
6,224,198 B1 5/2001 Cook et al.
6,243,115 B1 6/2001 Baker et al.
6,431,694 B1 * 8/2002 Ross ..... 347/85
6,733,114 B2 * 5/2004 Kobayashi et al. ..... 347/85
7,182,449 B2 * 2/2007 Inoue ..... 347/93

FOREIGN PATENT DOCUMENTS

EP 0 941 854 A2 9/1999
JP 2000-352379 A 12/2000
JP 2001-212975 A 8/2001

* cited by examiner

*Primary Examiner*—Anh T. N. Vo
(74) *Attorney, Agent, or Firm*—Sughrue Mion, PLLC

(57) ABSTRACT

In a printing apparatus of an off-carriage type, when a pump motor is rotated regularly for delivering pressurizing air to an ink cartridge, rotation thereof is converted into a linear reciprocating movement of a pressing member by a cam mechanism and a pressurizing operation is executed by repeating to operate to expand and contract a diaphragm. On the other hand, the pump motor is started to rotate inversely, a driven part is rotated by a friction clutch mechanism, and a pressing portion of the driven part is brought into contact with a valve opening lever of an atmospheric release valve. At this occasion, the valve opening lever is pivoted to bring a valve hole into an opened state and pressurizing air is discharged to outside by bringing the atmospheric release valve into an opened state.

17 Claims, 17 Drawing Sheets

PRESSURIZING PUMP DEVICE, LIQUID EJECTION APPARATUS AND METHOD OF CONTROLLING PRESSURIZING PUMP

BACKGROUND OF THE INVENTION

1. Field of the Invention

The present invention relates to a pressurizing pump device for discharging a pressurizing fluid by repeating suction and delivery, a liquid ejection apparatus, a flow path structure of a pressurizing pump, a method of stopping driving a pressurizing pump and a method of releasing a pressurization of a pressurizing fluid.

2. Related Art

In a background art, various kinds of printing apparatus have been developed and according to a kind of a printing apparatus, for example, for office use or for business, a large amount of ink is consumed in accordance with an increase in a printing frequency and therefore, the printing apparatus needs to mount an ink cartridge having a large capacity. However, when a kind of a printing apparatus mounted with an ink cartridge on a carriage (on-carriage type) is simply mounted with an ink cartridge having a large capacity, the carriage and therefore, the printing apparatus is large-sized and also the carriage per se is applied with a large load. Therefore, there has been developed a printing apparatus of an off-carriage type constituting a carriage and an ink cartridge by the separate members.

According to a printing apparatus of an off-carriage type, ink at inside of an ink cartridge needs to deliver to a side of a carriage (subtank on carriage). Therefore, the printing apparatus is mounted with a pressurizing pump and an ink pack at inside of a carriage is pressed to crash by delivering air pressurized by a pressurizing pump to a space at inside of the ink cartridge to thereby press ink to a side of the carriage. Further, the pressurizing pump repeats discharge of delivering out pressurized air and suction of taking in atmosphere into the pressurizing pump after the discharge to thereby supply ink.

As the pressurizing pump, a diaphragm type pump shown in, for example, JP-A-2000-352379 (pages 4 through 7, FIG. 2) is known. The diaphragm type pump is a pump of delivering pressurizing air by converting rotational movement of a drive motor into vertical movement of a diaphragm and expanding and contracting a pump chamber in accordance therewith. The diaphragm type pump is provided with a plurality (three in the pump of JP-A-2000-352379) of pump chambers on the same plane and the pump chambers repeat expanding and contracting operation successively in accordance with rotation of the drive motor to successively deliver pressurizing air.

However, when a diaphragm type pump shown in JP-A-2000-352379 is used, a plurality of pump chambers are present on a plane orthogonal to an axis center of the pump and therefore, the pump is large-sized in a diameter direction to pose a problem that a pressurizing pump and therefore, a printing apparatus is large-sized. Particularly, although a printing apparatus is requested to be downsized, since with regard to a size of a printing apparatus, also a size of a pressurizing pump occupies a large weight, there is a request of intending to reduce the size of the pressurizing pump as less as possible.

Further, a check valve is arranged on a delivery path of a pressurizing pump to increase a pressurized amount at each time of repeating pressurizing operation. Therefore, after the pressurizing pump is operated to pressurize, a high pressure state is maintained in an air supply tube constituting a way of passing pressurizing air. Meanwhile, when inside of the air supply tube is brought into an excessively high pressure state, a stable air pressure cannot be supplied to the ink cartridge. Further, when inside of the air supply tube space stays in the high pressure state in interchanging the ink cartridge, also a space in the cartridge communicated with the tube is brought into a high pressure state and the ink cartridge is brought into an expanded state and therefore, the ink cartridge becomes difficult to remove.

Therefore, it is necessary to arrange a pressure releasing mechanism for releasing pressurized air in the tube to outside. As the pressure releasing mechanism, there is known a pressure control valve serving also as an atmospheric release valve shown in, for example, JP-A-2001-212975 (pages 8 through 9, FIG. 7). The pressure control valve is constituted by a valve opening/closing structure using an electromagnetic valve, in details, a structure of bringing about a valve opening state by moving a lever or the like when electricity is conducted to an electromagnetic plunger by an instruction from a control apparatus. Further, inside of the air supply tube is released to the atmosphere by opening the pressure control valve when the air supply tube is brought into the excessively high pressure state or when a power source of the printing apparatus is made OFF.

In this case, there is conceivable a constitution of combining, for example, JP-A-2000-352379 and JP-A-2001-212975 as a printing apparatus of an off-carriage type having a pressure control valve (serving also as an atmospheric release valve). However, when the diaphragm type pump shown in JP-A-2000-35237 is used, in view of a current situation that since a plurality of pump chambers are present on the same plane of the pump, a diameter of the pressurizing pump is large, there poses a problem that the pressurizing pump and therefore, the printing apparatus is large-sized.

Further, the pressure control valve shown in JP-A-2001-212975 is constituted by the structure of using the electromagnetic valve having a large size, also in the case of using the pressure control valve, there poses a problem that a pump unit including the pressurizing pump and the pressure control valve and therefore, the printing apparatus is large-sized. Further, when the pressure control valve shown in JP-A-2001-212975 is used, in addition to control of the drive motor for moving the pressurizing pump, also a control of the pressure control valve is needed to thereby pose also a problem of complicating a control system.

Further as the pressurizing pump disclosed in JP-A-2000-352379 (pages 4, 5, FIG. 1), a printing apparatus is mounted with a pressure detector for detecting a pressure of pressurizing air discharged by a pressurizing pump and a control apparatus for calculating a pressure value of pressurizing air based on a detected value of the pressure detector. Further, when the pressure value of the pressurizing air is lower than a set pressure, the pressurizing pump is brought into a driving state, when the pressure value of pressuring air is not less than the set value, the pressurizing pump is brought into a stationary state and pressurizing air is maintained at a pressure value in a predetermined range by repeating to drive and stop the pressurizing pump.

Meanwhile, when a pressure waveform 90 of pressurizing air is shown in FIG. 23, a pressure of pressurizing air drops with an elapse of time after stopping driving the pump by being caused by a small amount of leakage of an air path, an increase in a space volume in an ink cartridge by consuming ink or the like. Therefore, when the pump is stopped to drive immediately at a time point at which the pressure value of pressurizing air becomes a set value, it is necessary to restart to drive the pump by a short time interval and therefore, a frequency of stopping and restarting to drive the pump is increased and a hindrance is brought about in durability of the pump. Hence, as shown by a one-dotted chain line of FIG. 23, the problem is dealt with by applying additional pressurization by continuing to drive the pump for a predetermined time period even when the pressure value becomes not less than the set value and stopping driving the pump after making the pressure value of pressurizing air higher than the set value.

Here, depending on cases, there also is a case in which the pressure value of pressurizing air becomes not less than the set value in a state in which the diaphragm is contracted and the pressurizing pump is stopped in the state in which the diaphragm is contracted. In this case, the diaphragm is left for a long period of time in the contract state and there is also a possibility of deforming the diaphragm by creep thereby. When the diaphragm is deformed by creep, there is brought about a state in which the pressurizing pump cannot exert a sufficient pressurizing force and therefore, there poses a problem of deteriorating a pumping function of the pressurizing pump.

SUMMARY OF THE INVENTION

It is an object of the invention to provide a pressurizing pump device, a liquid ejection apparatus and a method of releasing a pressurization of a pressurizing fluid capable of downsizing an apparatus size.

Further another object of the invention is to provide a pressurizing pump device, a liquid ejection apparatus and a method of stopping driving a pressurizing pump capable of restraining a pumping function from being deteriorated while ensuring durability of the pump.

In order to resolve the above-described problem, the invention constitutes a gist thereof by a pressurizing pump device comprising a drive motor for driving a pump, a pump portion of discharging a pressurizing fluid from a pump chamber by increasing and reducing a volume of the pump chamber by linearly reciprocating to move a pressing member for pressing the pump chamber, a converting mechanism converting a rotational movement of the drive motor into a linear reciprocating movement to thereby linearly reciprocate the pressing member, a valve mechanism provided in a fluid path tube in which the pressurizing fluid flows and capable of releasing a pressurization by the pressurizing fluid, wherein a control unit executes a pressurizing operation of the pump portion where a rotation of the drive motor in one direction is converted into the linear reciprocating movement of the pressing member by the converting mechanism, and the pressurization is releasable by bringing the valve mechanism into an opened state by rotating the drive motor in another direction.

According to the constitution, in executing the pressurizing operation, the pressurizing operation carried out by rotating the drive motor in one direction and in releasing a pressurization, the pressurizing releasing operation is carried out by switching rotation of the drive motor to rotation in the other direction. Therefore, the same drive motor can be used in both of the pressurizing operation and pressurizing releasing operation, for example, an electromagnetic valve or the like having a large part size may not be used in the valve opening mechanism in releasing a pressurization and therefore, small-sized formation of the pressurizing pump device is achieved. Further, in bringing the valve mechanism into the opened state, the drive motor is only rotated in other direction and therefore, a control of opening the valve mechanism is constituted by a simple control.

The invention constitutes a gist thereof by further comprising a pressure detector for detecting a pressure of the pressurizing fluid flowing in the fluid path tube, wherein the control unit calculates a pressure value based on a detected value of the pressure detector and releases a pressurization by the pressurizing fluid by bringing the valve mechanism into the opened state by rotating the drive motor in the other direction when the pressure value becomes not less than a first threshold.

According to the constitution, the first threshold which can be regarded as the excessive pressure value is set, when the pressure value of the pressurizing fluid becomes not less than the first threshold, the valve element of the valve mechanism is opened. Therefore, the pressure of the pressurizing fluid may not be increased excessively, which contributes to promote durability of the pressurizing pump device.

The invention constitutes a gist thereof by that the pump portion comprises a diaphragm provided with a check valve allowing only to suck the fluid from outside at a suction port and provided with a check valve allowing only to discharge the fluid at a discharge port.

According to the constitution, there is adopted the diaphragm having the check valve allowing only to suck the fluid (for example, outside air) from outside (that is, one way valve for suction) at the suction port and having the check valve allowing only to discharge the pressurizing fluid (that is, one way valve for discharge) at the discharge port. Therefore, the diaphragm is constructed by a constitution of increasing the pressurizing force of the diaphragm in accordance with the linear reciprocating movement and therefore, even when the diaphragm is downsized, the sufficient pressurizing force can be achieved and the diaphragm and therefore, the pressurizing pump device can be downsized.

The invention constitutes a gist thereof by that the pump portion comprises a cylinder provided with a check valve allowing only to suck the fluid from outside at a suction port and provided with a check valve allowing only to discharge the pressurizing fluid at a discharge port.

According to the constitution, there is adopted the cylinder having the check valve allowing only to suck the fluid (for example, outside air) from outside (that is, one way valve for suction) at the suction port and having the check valve allowing only to discharge the pressurizing fluid (that is, one way valve for discharge) at the discharge port. Therefore, there is constructed the constitution of increasing the pressurizing force of the cylinder in accordance with reciprocal movement of the piston and therefore, even when the cylinder is downsized, the sufficient pressurizing force can be achieved and the cylinder and therefore, the pressurizing pump device can be downsized.

The invention constitutes a gist thereof by that the valve mechanism comprises a lever member pivotally supported by a valve main body, a valve element integrally formed with the lever member, a valve hole opened and closed by the valve element, and an urging member for urging the lever member in a direction of opening the valve element, when the drive motor is rotated in one direction, the valve element is brought into a closed state by urging the lever member to a side of the valve hole by an urge force of the urging member, and when the drive motor is rotated in other direction, the lever member is pivoted by operating the valve mechanism and the valve element is brought into the opened state.

According to the constitution, when the motor is rotated inversely, the valve mechanism is operated based thereon and the lever member is pivoted and the valve element of the valve mechanism is brought into the opened state. Therefore, the valve element of the valve mechanism can be opened and closed by a mechanical structure and therefore, the structure of opening and closing the valve mechanism is simplified.

The invention constitutes a gist thereof by that the valve element of the valve mechanism is automatically brought into the opened state when the pressure value of the pressurizing fluid staying at the valve chamber of its own becomes not less than a second threshold set to a value larger than the first threshold.

According to the constitution, when the pressure value of the pressurizing fluid staying in the valve chamber of its own becomes not less than the second threshold (> first threshold), valve mechanism is automatically brought into the opened state. Therefore, even when the pressure detector is failed or a control system by the control unit runs wild, the pressure of the pressurizing fluid does not become not less than the second threshold and therefore, the pressure of the pressurizing fluid does not increase excessively, which further contributes to promote durability of the pressurization apparatus.

The invention constitutes a gist thereof by that the valve mechanism comprises a friction clutch mechanism for pivoting the lever member by bringing a pressing portion of the driven part into contact with the lever member by rotating the driven part along with the drive motor via the friction clutch when the drive motor is rotated in other direction.

According to the constitution, when the friction clutch mechanism is used for the valve mechanism, a hazard is not brought about even when the motor continues to rotate after the pressing portion is brought into contact with the lever member and therefore, even when the pressing portion of the driven part is brought into contact with the lever member, the drive motor may not stop rotating. Therefore, the control of the drive motor is simplified and also a position detector of viewing a rotational operation of the drive motor is not needed.

The invention constitutes a gist thereof by that a speed reduction ratio of the friction clutch is set to be larger than a speed reduction ratio of a gear mechanism for transmitting rotation of the drive motor to the converting mechanism.

According to the constitution, when the friction clutch mechanism is used for the valve mechanism, even in the pressurizing operation of rotating the drive motor in one direction, the driven member is rotated via the friction clutch. However, since the speed reduction ratio of the friction clutch is set to be large, a load other than a load necessary for the pressurizing operation, that is, a load necessary for operating the pump portion can be reduced.

The invention constitutes a gist thereof by a liquid ejection apparatus comprising a liquid cartridge for discharging a liquid by expanding and contracting a liquid containing portion to an inner portion thereof by being supplied with a pressurizing fluid to a space of the inner portion, a liquid ejection head capable of ejecting the fluid, a liquid path tube for guiding the liquid from the liquid cartridge to the liquid ejection head, a pressurizing pump device for supplying a pressurizing fluid into the liquid cartridge, and a fluid path tube for guiding the pressurizing fluid into the liquid cartridge, wherein the pressurizing pump device comprises a drive motor for driving a pump, a pump portion for discharging the pressurizing fluid from a pump chamber by increasing and reducing a volume of the pump chamber by linearly reciprocating to move a pressing member for pressing the pump chamber, a converting mechanism converting a rotational movement of the drive motor into a linear reciprocating movement to thereby linearly reciprocate the pressing member, a valve mechanism provided in a fluid path tube in which the pressurizing fluid flows and capable of releasing a pressurization by the pressurizing fluid, wherein a control unit executes a pressurizing operation of the pump portion where a rotation of the drive motor in one direction is converted into the linear reciprocating movement of the pressing member by the converting mechanism, and a pressurization is releasable by bringing the valve mechanism into an opened state by rotating the drive motor in another direction.

According to the constitution, in executing the pressurizing operation, the pressurizing operation is executed by rotating the drive motor in one direction and in executing pressurization releasing operation, the pressurization releasing operation is executed by switching rotation of the drive motor to rotation in other direction. Therefore, the same drive motor can be used for both of the pressurizing operation and the pressurization releasing operation, for example, an electromagnetic valve or the like having a large part size may not be used for the valve opening mechanism in releasing a pressurization and therefore, the pressurizing pump device and therefore, the liquid ejection apparatus can be downsized. Further, in bringing the valve mechanism into the opened state, the drive motor is only rotated in other direction and therefore, the control of opening the valve mechanism is constituted by a simple control.

The invention constitutes a gist thereof by a method of releasing a pressurization of a pressurizing fluid used in a pressurizing pump device comprising a drive motor for driving a pump, a pump portion for discharging a pressurizing fluid from a pump chamber by increasing and reducing a volume of the pump chamber by linearly reciprocating to move a pressing member for pressing the pump chamber, a converting mechanism converting a rotational movement of the drive motor into a linear reciprocating movement to thereby linearly reciprocate the pressing member, a valve mechanism provided in a fluid path tube in which the pressurizing fluid flows and capable of releasing a pressurization by the pressurizing fluid, and a control unit for controlling the drive motor, wherein a control unit executes a pressurizing operation of the pump portion where a rotation of the drive motor in one direction is converted into the linear reciprocating movement of the pressing member by the converting mechanism, and the pressurization is releasable by bringing the valve mechanism into an opened state by rotating the drive motor in another direction.

In order to resolve the above-describe problem, the invention constitutes a gist thereof by a pressurizing pump device comprising a drive motor for driving a pump, a pump portion for discharging a pressurizing fluid from a pump chamber by increasing and reducing a volume of the pump chamber by linearly reciprocating to move a pressing member for pressing the pump chamber, a converting mechanism for converting a rotational movement of the drive motor into a linear reciprocating movement of the pressing member when the drive motor is rotated at least in one direction, and a valve mechanism provided in a fluid path tube in which the pressuring fluid flows and capable of releasing a pressurization by the pressurizing fluid by being brought into an opened state when the drive motor is rotated in other direction, the pressurizing pump mechanism comprising a pressure detector for detecting a pressure of the pressurizing fluid flowing in the fluid path tube, a position detecting device for detecting a home position of the pressing member at which the pressing member starts to move; a calculating unit for calculating a pressure value of the pressurizing fluid based on a detected value of the pressure detector, and a control unit for starting to determine a position of the pressurizing member based on the detected value from the position detecting device after elapsing a predetermined time period when it is determined that a pressurizing operation of the pump portion is to be stopped based on the pressure value calculated by the calculating unit and stopping the drive motor when the pressing member reaches the home position.

According to the constitution, the pressurizing operation is operated such that when the pressurizing operation is started, the pressurizing fluid is discharged from the pump portion, and when the pressure value of the pressurizing fluid reaches a value by which the pressurizing operation is to be stopped, the drive motor is stopped. At this occasion, the position of pressing member is started to determine after elapsing the predetermined time period since the pressurizing operation has been determined to be stopped, and when the pressing member reaches the home position, the drive motor is stopped and the pressurizing operation is stopped. Therefore, operation is at standby by the predetermined time period until detecting the position of the pressing member after the pressing operation has been determined to be stopped and therefore, the pressing operation is continued during the time period and the pressurizing fluid is pressurized to a pressure higher than normal by the additional pressurization.

Here, in the case of operating the pressurizing pump device such that the pressurizing fluid is supplied by a pressure value in a predetermined range by, for example, repeating the pressurizing operation and pressurizing releasing operation, the pressure of the pressurizing fluid becomes the pressure higher than normal by executing the additional pressurization and therefore, even when a small amount of leakage or the like is brought about in the fluid path tube, it is not necessary to frequently repeat the pressurizing operation and the pressurization releasing operation and durability of the pressurizing pump device can be promoted and the control can be simplified. Further, in stopping the pressurizing operation, when the pressing member reaches the home position, the drive motor is stopped and therefore, it is difficult to bring about a situation under which the pressing member is left for a long period of time to a position of deteriorating the pump portion and also a pumping function is restrained from being deteriorated.

The invention constitutes a gist thereof by the pressurizing pump device further comprising a pressurizing operation controlling unit for starting to drive the pump portion by rotating the drive motor in the one direction, stopping driving the pump portion when the pressure value becomes not less than a set value, driving the pump portion again when the pressure value becomes lower than the set pressure and executing the pressurizing operation by repeating the operation, wherein the control unit starts to determine the position of the pressing member based on the detected value from the position detecting device after elapsing the predetermined time period since the pressure value has become not less than the set value in executing the pressurizing operation by the pressurizing operation controlling unit and stopping driving the pump portion by stopping the drive motor when the pressurizing member reaches the home position.

According to the constitution, even when the pressurizing operation and the pressurization releasing operation are repeated to supply the pressurizing fluid by the pressure value in the predetermined range, the pressurizing fluid is pressurized to the pressure higher than normal by the additional pressurization and therefore, it is not necessary to repeat the pressurizing operation and the pressurization releasing operation frequently. Therefore, although when the pressurizing operation and the pressurization releasing operation are repeated frequently, an excessive load is applied on the pressuring pump device to effect an influence on service life or the like of the apparatus, by adopting the constitution of the example, durability of the pressurizing pump device can be promoted and control can be simplified.

The invention constitutes a gist thereof by the pressurizing pump device further comprising a pressurization releasing controlling unit for executing a pressurization releasing operation by bringing the valve mechanism into an opened state by rotating the drive motor in the other direction when it is determined that the pressurization releasing operation is to be executed based on the detected value of the pressure detector or an operation to a main body of the apparatus, wherein the control unit starts to determine the position of the pressing member based on the detected value from the position detecting device after the pressure value becomes lower than a predetermined threshold in executing the pressurization releasing operation by the pressurization releasing controlling unit and stopping the drive motor when the pressing member reaches the home position.

According to the constitution, since the pressurization releasing operation is executed when the pressure is increased abnormally or when the power source of the apparatus is made OFF and therefore, there is a high possibility that after the pressurization releasing operation, the pressurizing pump device is brought into a paused state for a long period of time. However, when the motor is stopped to be driven in the pressurization releasing operation, the drive motor is stopped when the pressing member reaches the home position and therefore, the pressurizing pump device is stopped to be driven in a state in which the pressing member is disposed at a preferable position. Therefore, the pressing member is not left at an unpreferable position for a long period of time, which is much effective in restraining the pumping function from being deteriorated.

The invention constitutes a gist thereof by starting to determine the position of the pressing member based on the detected value from the position detecting device after elapsing the predetermined time period since the pressure value has become lower than the predetermined threshold in executing the pressurization releasing operation by the pressurization releasing controlling unit and stopping the drive motor when the pressurizing member reaches the home position.

According to the constitution, even when the pressure value becomes lower than the threshold, the valve opening operation is continued for the predetermined time period and therefore, a time period for operating to open the valve mechanism is prolonged and the pressurization releasing operation can further firmly be executed.

The invention constitutes a gist thereof by that the predetermined time period is not less than a time period necessary for reciprocating the pressing member at least by one reciprocation.

According to the constitution, in pressurizing the pressurizing fluid by the pressure higher than normal by additional pressurization in, for example, pressurizing operation, the pressing member is reciprocated at least by one reciprocation and therefore, the pressure of the pressurizing fluid can be increased to a sufficient pressure value.

The invention constitutes a gist thereof by a liquid ejection apparatus comprising a liquid cartridge for discharging a liquid by expanding and contracting a liquid containing portion at inside thereof by supplying a pressurizing fluid to a space at the inside, a liquid ejection head capable of ejecting the liquid, a liquid path tube for guiding the liquid of the liquid cartridge to the liquid ejection head, a pressurizing pump device for supplying the pressurizing fluid into the liquid cartridge, and a fluid path tube for guiding the pressurizing fluid into the liquid cartridge, wherein the pressurizing pump device comprises a drive motor for driving a pump, a pump portion for discharging the pressurizing fluid from a pump chamber by increasing and reducing a volume of the pump chamber by linearly reciprocating to move a pressing member for pressing the pump chamber, a converting mechanism for converting a rotational movement of the drive motor into a linear reciprocating movement of the pressing member when the drive motor is rotated at least in one direction, and a valve mechanism provided in a fluid path tube in which the pressurizing fluid flows and capable of releasing a pressurization by the pressurizing fluid by being brought into an opened state when the drive motor is rotated in other direction, further comprising a pressure detector for detecting a pressure of the pressurizing fluid flowing in the fluid path tube, a position detecting device for detecting a home position of the pressing member at which the pressing member starts to move; a calculating unit for calculating a pressure value of the pressurizing fluid based on a detected value of the pressure detector, and a control unit for starting to determine a position of the pressing member based on a detected value from the position detecting device after elapsing a predetermined time period when it is determined that the drive motor is to be stopped based of the pressure value calculated by the calculating unit and stopping the drive motor when the pressing member reaches the home position.

According to the constitution, when the pressurizing operation is started, the pressurizing pump device is operated such that the drive motor is stopped when the liquid is supplied to the liquid cartridge by the pressurizing fluid from the pump portion and the pressure value of the pressurizing fluid reaches a value by which the pressurizing operation is to be stopped. At this occasion, the position of the pressurized member is started to determine after elapsing the predetermined time period since the pressurizing operation has been determined to be stopped, and when the pressurizing member reaches the home position, the drive motor is stopped to stop the pressurizing operation. Therefore, operation is at standby for the predetermined time period until detecting the position of the pressing member since it has been determined that the pressing operation is to be stopped and therefore, the pressurizing operation is continued during the time period and the pressure of the pressurizing fluid is increased to the pressure higher than normal by the additional pressurization.

Here, when the pressurizing pump device is operated such that the pressurizing fluid is supplied by the pressure value in the predetermined range by, for example, repeating the pressurizing operation and the pressurization releasing operation, pressure of the pressurizing fluid becomes a pressure higher than normal by executing the additional pressurization and therefore, even when a small amount of leakage is brought about in the fluid path tube, it is not necessary to repeat the pressurizing operation and the pressurization releasing operation frequently and durability of the pressurizing pump device and therefore, the liquid ejection apparatus can be promoted and the control can be simplified. Further, in stopping the pressurizing operation, when the pressurizing member reaches the home position, the drive motor is stopped and therefore, it is difficult to bring about a situation under which the pressing member is left at a position by which the pump portion is deteriorated for a long period of time, also a pumping function is restrained from being deteriorated and also reliability of the liquid ejection apparatus is promoted.

The invention constitutes a gist thereof by a method of stopping driving a pressurizing pump used in a pressurizing pump device comprising a drive motor for driving a pump, a pump portion for discharging a pressurizing fluid from a pump chamber by increasing and reducing a volume of the pump chamber by linearly reciprocating to move a pressing member for pressing the pump chamber, a converting mechanism for converting a rotational movement of the drive motor into a linear reciprocating movement of the pressing member when the drive motor is rotated at least in one direction, a valve mechanism provided in a fluid path tube in which the pressurizing fluid flows and capable of releasing a pressurization by the pressurizing fluid by being brought into an opened state when the drive motor is rotated in other direction, and a control unit for controlling the drive motor, wherein a pressure of the pressurizing fluid flowing in the fluid path tube is detected by a pressure detector, it is detected whether the pressing member is disposed at a home position constituting a position of starting to move the pressing member by position detecting device, and a pressure value of the pressurizing fluid is calculated by a calculating unit based on a detected value of the pressure detector, and wherein the control unit starts to determine a position of the pressing member based on a detected value from the position detecting device after elapsing a predetermined time period when it is determined that the drive motor is to be stopped based on the pressure value calculated by the calculating unit and stopping the drive motor when the pressing member reaches the home position. According to the invention, operation similar to that of claim 1 can be achieved.

In order to resolve the above-described problem, the invention constitutes a gist thereof by a pressurizing pump device comprising driving means for driving a pump, and a pump portion for discharging a pressurizing fluid from a pump chamber by increasing and reducing a volume of the pump chamber by the drive source of the driving means, wherein the pump portion comprises a suction port for drawing a fluid from outside into the pump chamber and a delivery port for delivering the pressurizing fluid from inside of the pump chamber by a pressurizing operation and the suction port and the delivery port are arranged at positions opposed to each other.

According to the constitution, when the suction port and the delivery port are arranged at positions opposed to each other, a size in a diameter direction of the pressurizing pump device is restrained to be small by that amount and therefore, the size in the diameter direction of the pressurizing pump device can be downsized.

The invention constitutes a gist thereof by that the pump portion comprises a compressing portion having the pump chamber and the suction port, a seat portion supported by the compressing portion to be able to move relative thereto and having the delivery port and a seal member arranged on a suction path produced between the compressing portion and the seat portion, wherein when the pump portion is operated to increase the volume of the pump chamber, the seal member is separated from one of the compressing portion and the seat portion in accordance with separating the compressing portion from the seat portion, the suction port and the suction path are communicated with each other to bring about a suction state and when the pump portion is operated to reduce the volume of the pump portion, the compressing portion is moved to a side of the seat portion by a pressurizing force in the pump chamber when the pump portion is operated and the seal member is brought into close contact with the compressing portion and the seat portion and the suction port is communicated only with the delivery port to bring about a delivery state by operating the pump portion.

According to the constitution, when the compressing portion is separated from the seat portion in accordance with an increase in the volume of the pump chamber, the seal member opens the suction path to bring about the suction state and when the compressing portion is moved to a side of the seat portion in accordance with a reduction in the volume of the pump chamber, the seal member closes the suction path to bring about the delivery state. Therefore, when the constitution is used, even when the suction port and the delivery port are arranged at the positions opposed to each other, the suction side check valve mechanism can be constituted by a simple structure and is downsized.

The invention constitutes a gist thereof by further comprising a delivery side check valve mechanism having a valve member capable of opening and closing the delivery port and arranged on a delivery path, wherein when the volume of the pump chamber is increased and the pump portion is brought into the suction state, the valve member closes the delivery port to bring about a closed state and when the volume of the pump chamber is reduced and the pump portion is brought into a delivery state, the valve member opens the delivery port to bring about an opened state.

According to the constitution, the delivery side check valve mechanism for preventing the pressurizing fluid from flowing back to the pump chamber is provided on the delivery path of the pump portion and therefore, a pressuring force of the pump portion is gradually increased in accordance with operation of the pump portion. Therefore, even when the pump portion is downsized, the sufficient pressurizing force can be achieved and the pump portion and therefore, the pressurizing pump device can be downsized.

The invention constitutes a gist thereof by that urging means for urging the valve member to the closed side is interposed between the seat portion and the valve member.

According to the constitution, the valve member of the delivery side check valve mechanism is always urged to the closed side by the urging means and therefore, for example, even when the pressurizing pump device is impacted or when an attitude position of the pressurizing pump device is changed, it is difficult to bring about a state of opening the valve member unintentionally. Therefore, it is difficult to bring about a drawback in which the delivery side check valve mechanism which is to be in the closed state is brought into the opened state and certainty of operating to open and close the valve member is promoted.

The invention constitutes a gist thereof by that second urging means for urging the compressing portion to a side of the seat portion to maximize the volume of the pump chamber is interposed between the compressing portion and the seat portion.

According to the constitution, when the pump portion is constituted by, for example, a diaphragm, when the diaphragm is expanded, the fluid is sucked into the pump chamber and when the diaphragm is contracted, the pressurized fluid is delivered from the pump chamber to outside. In the case of such a diaphragm type pump, when the diaphragm is left to be contracted for a long period of time, the diaphragm is deformed by creep to deteriorate a pumping function. However, when the pump portion is provided with the second urging means, the diaphragm is urged to a side of being expanded by the second urging means and therefore, the diaphragm is difficult to be brought into a contracted state. Therefore, it is difficult to deform the diaphragm by creep and it is difficult to deteriorate the pumping function.

The invention constitutes a gist thereof by that the driving means is a drive motor for exerting a rotational force in a predetermined direction and the pump portion is constructed by a constitution of discharging the pressurizing fluid from the pump chamber by increasing and reducing the volume of the pump chamber by linearly reciprocating to move a pressing member for pressing the pump chamber, further comprising a converting mechanism for converting a rotational movement of the drive motor into a linear reciprocating movement to linearly reciprocate to move the pressing member.

According to the constitution, there is constructed a constitution of operating the pump portion by converting the rotational movement of the drive motor into the linear reciprocating movement of the pressing member by the converting mechanism and therefore, a general purpose motor normally used widely can be used as the pump drive source, which contributes to simplify the pressurizing pump device and reduce cost.

The invention constitutes a gist thereof by further comprising a valve mechanism provided in a fluid path tube in which the pressurizing fluid flows and capable of releasing a pressurization by the pressurizing fluid, and a control unit for executing a pressurizing operation by converting rotation of the drive motor into a linear reciprocating movement of the pressing member by rotating the drive motor at least in one direction and a releasing pressurizing operation by bringing the valve mechanism into the opened state by rotating the drive motor in other direction.

According to the constitution, when the pressurizing operation is executed, the pressurizing operation is executed by rotating the drive motor in one direction and when the pressurization releasing operation is executed, the pressurization releasing operation is executed by switching rotation of the drive motor rotation in other direction. Therefore, the same drive motor can be used in both of the pressurizing operation and the pressurization releasing operation, it is not necessary to use, for example, an electromagnetic valve or the like having a large part size in the valve opening mechanism in the pressurization releasing operation and therefore, the pressurizing pump device is downsized. Further, in bringing the valve mechanism to the opened state, only the drive motor is rotated in other direction and therefore, control of opening the valve mechanism is executed by simple control.

The invention constitutes a gist thereof by a liquid ejection apparatus comprising a liquid cartridge for discharging a liquid by expanding and contracting a liquid containing portion at an inner portion thereof by supplying a pressurizing fluid to a space at the inner portion, a liquid ejection head capable of ejecting the liquid, a liquid path tube for guiding the liquid of the liquid cartridge to the liquid ejection head, a pressurizing pump device for supplying the pressurizing fluid into the liquid cartridge, and a fluid path tube for guiding the pressurizing fluid into the liquid cartridge, wherein the pressurizing pump device comprises driving means for driving a pump and a pump portion for discharging the pressurizing fluid from a pump chamber by increasing and reducing a volume of the pump chamber by constituting a drive source thereof by the driving means, and wherein the pump portion comprises a suction port for drawing a fluid from outside into the pump chamber, and a delivery port for delivering the pressurizing fluid from inside of the pump chamber by a pressurizing operation, and the suction port and the delivery port are arranged at positions opposed to each other.

According to the constitution, when the suction port and the delivery port are arranged at positions opposed to each other, a size in a diameter direction of the pressurizing pump device can be restrained to be small by that amount and therefore, the size in the diameter direction of the pressurizing pump device can be downsized, which contributes also to downsize the printing apparatus.

The invention constitutes a gist thereof by a flow path structure of a pressurizing pump used in a pressurizing pump device comprising driving means for driving a pump, and a pump portion for discharging a pressurizing fluid from the pump chamber by increasing and reducing a volume of the pump chamber by constituting a drive source thereof by the driving means, wherein the pump portion is formed with a suction port for drawing a fluid from outside into the pump chamber and a delivery port for delivering the pressurizing fluid from inside of the pump chamber by a pressurizing operation and the suction port and the delivery port are arranged at positions opposed to each other. According to the invention, operation similar to that of claim 1 is achieved.

BRIEF DESCRIPTION OF THE DRAWINGS

FIG. 21A is a side sectional view of a pump portion in a suction state, FIG. 21B is a side sectional view of the pump portion in a discharge state.

FIG. 22A is a side sectional view of the pump portion in a suction state, FIG. 22B is a side sectional view of the pump portion in a discharge state.

DETAILED DESCRIPTION OF THE PREFERRED EMBODIMENTS

First Embodiment

An explanation will be given of the first embodiment of a pressurizing pump device, a liquid ejection apparatus and a method of releasing a pressurization of a pressurized fluid embodying the invention in reference to FIG. 1 through FIG. 16 as follows.

Figure 1:
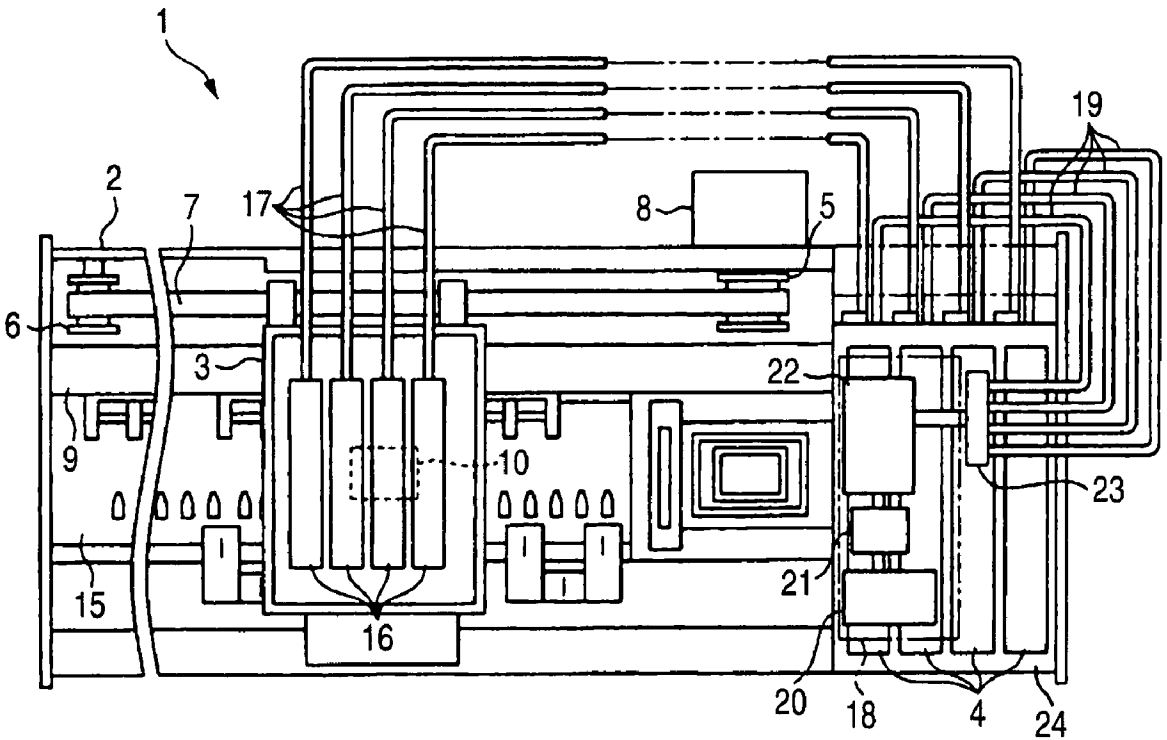
FIG. 1 is a plane view showing an outline constitution of inside of a case of a printing apparatus according to first embodiment.

FIG. 1 is a plane view showing an outline constitution of inside of a case of a printing apparatus 1. The printing apparatus 1 is of an off-carriage including a carriage 3 and an ink cartridge 4 at inside of a main body case 2 and constituting the carriage 3 and the ink cartridge 4 by separate members. The carriage 3 is attached to an endless timing belt 7 expanded by a drive pulley 5 and a driven pulley 6, and is reciprocated to move in a main scanning direction (left and right direction of FIG. 1) in a state of being guided by a guide shaft 9 by driving the timing belt 7 by a carriage motor 8. Further, the printing apparatus 1 corresponds to a liquid ejection apparatus, and the ink cartridge 4 corresponds to a liquid cartridge.

A lower face of the carriage 3 is attached with a recording head 10 having a plurality of nozzle holes. A lower end side of the printing apparatus 1 is mounted with a sheet feeding motor 11 (refer to FIG. 13) constituting a drive source in feeding printing sheet. An output shaft of a sheet feeding motor 11 is fixed with a gear and the gear is connected to a sheet feeding roller 12 and a sheet discharging roller 13 (refer to FIG. 13 of both) via a gear train. When the sheet feeding motor 11 is rotated, the sheet feeding roller 12 and the sheet discharging roller 13 are rotated and sheet 14 is fed in a sub scanning direction (up and down direction of FIG. 1) along a sheet feeding member 15. Further, the recording head 10 corresponds to a liquid ejection head.

The carriage 3 is mounted with a sub tank (also referred to as valve unit) 16 for supplying ink to the recording head 10. The ink cartridges 4 and subtanks 16 are arranged by a number of ink colors (for example, black, yellow, magenta, cyan) and the subtanks 16 are connected to the ink cartridges 4 of respective colors via ink supply tubes 17 for respective colors. The respective subtanks 16 temporarily store inks taken in from the ink cartridges 4 and controls pressures of the stored ink to predetermined pressures to supply to the recording head 10.

An end portion of the main body case 2 is mounted with a pressurizing unit 18 at an upper face of the ink cartridge 4. The pressurizing unit 18 is an apparatus of delivering pressuring air (pressuring fluid) to the ink cartridge 4 via an air supply tube 19 and is provided with a pressuring pump 20, a pressure sensor 21 and an atmospheric release valve 22. The air supply tube 19 is branched to a plurality (4 pieces in this example) thereof by a divider 23 on a downstream side of the atmospheric release valve 22 and the respective branched tubes are connected to respective colors of the ink cartridges 4. Further, the ink supply tube 17 corresponds to a liquid path tube, the pressurizing unit 18 corresponds to a pressuring pump device, the air supply tube 19 corresponds to an air flow tube and the pressure sensor 21 corresponds to pressure detector.

Figure 2:
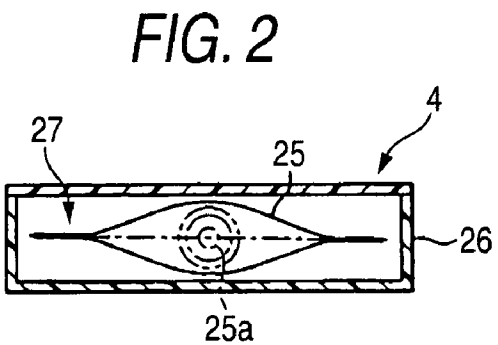
FIG. 2 is a sectional view showing a constitution of an ink cartridge.

The ink cartridge 4 is attachably and detachably contained in a cartridge holder 24 provided to the main body case 2. As shown by FIG. 2, the ink cartridge 4 comprises an ink pack 25 filled with ink and an ink case 26 for containing the ink pack 25. The ink pack 25 includes an ink discharge port 25*a* and the ink discharge port 25*a* is connected with the ink supply tube 17. Only the ink discharge port 25*a* of the ink pack 25 is exposed to outside, the other portion is contained in the ink case 26 in an air tight state, thereby, a space 27 in an air tight state is formed at inside of the ink case 26. Further, the ink pack 25 corresponds to a liquid containing portion.

Further, the ink case 26 is formed with a communication hole (not illustrated) communicated with the space 27 and by connecting the air supply tube 19 to the communication hole, the communication hole and the air supply tube 19 are brought into a communicated state. When pressurizing air is discharged by operating the pressurizing pump 20, the pressurizing air is introduced into the space 27 at inside of the ink cartridge 4 by transmitting the air supply tube 19, and the ink pack 25 is pressed to crush by an air pressure of the pressurizing air. Thereby, ink at inside of the ink pack 25 is supplied to the subtank 16 via the ink supply tube 17.

In this way, ink is supplied to the subtank 16 by increasing the pressure of pressuring air by repeating discharge and suction of the pressurizing pump 20 and pressing to crush the ink pack 25. The ink is temporarily stored in the subtank 16 and is supplied to the recording head 10 in a state of controlling the pressure. The printing apparatus 1 carries out a printing processing by driving the carriage motor 8 and the sheet feeding motor 11 and ejecting ink from the recording head 10 based on printing data inputted from a host computer or a memory card.

Figure 3:
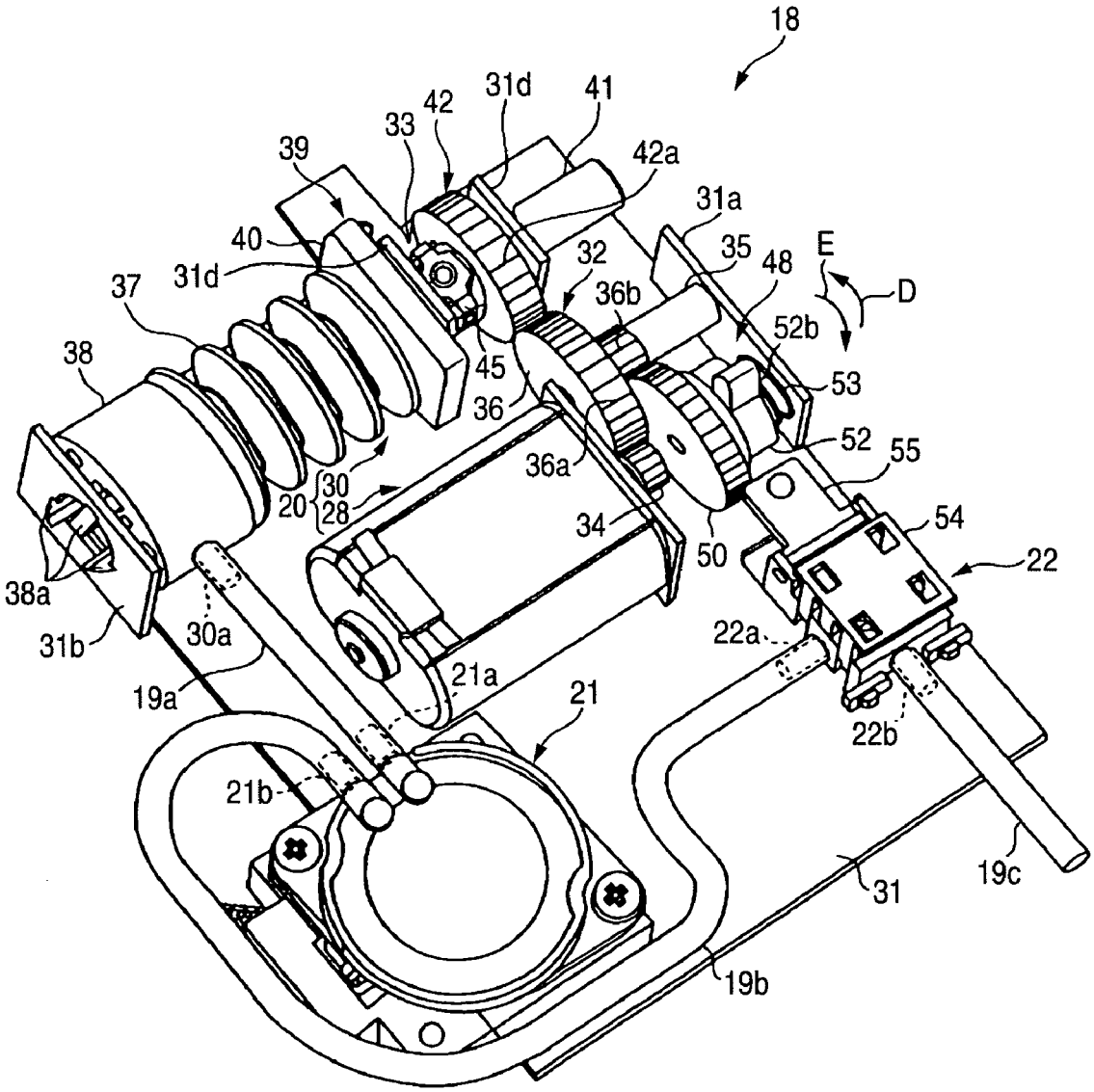
FIG. 3 is a perspective view of a pressurizing unit for delivering pressurizing air to the ink cartridge.
Figure 4:
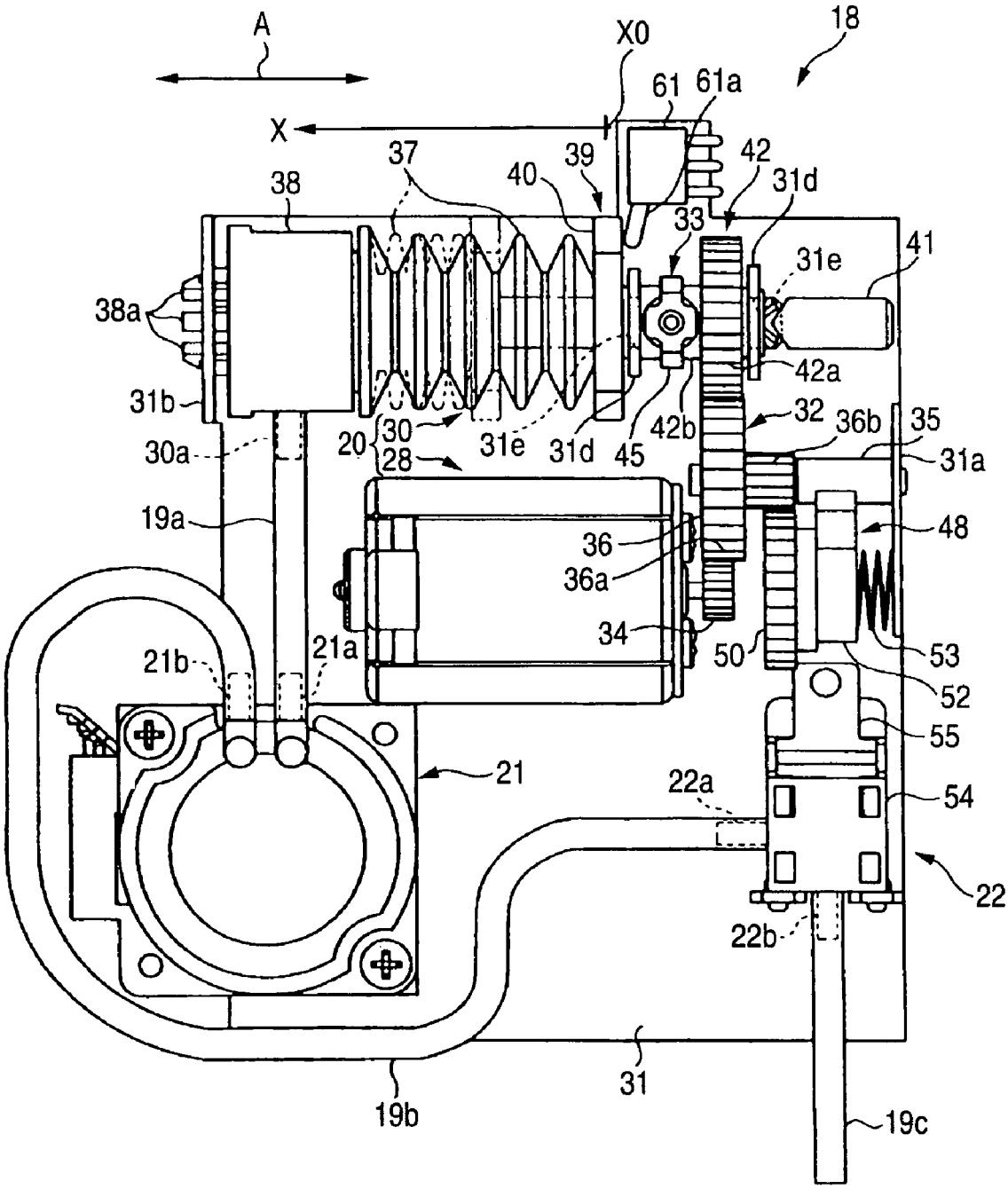
FIG. 4 is a plane view of the pressurizing unit for delivering pressurizing air to the ink cartridge.

FIG. 3 is a perspective view of the pressuring unit 18 and FIG. 4 is a plane view of the pressuring unit 18. The pressurizing pump 20 is a diaphragm type pump and is provided with a pump motor 28 constituting a source of driving the pump, and a pump portion 30 having a pump chamber 29 (refer to FIG. 7 and FIG. 8) at inside thereof. The pressurizing unit 18 is unitized by attaching the pressurizing pump 20, the pressure sensor 21 and the atmospheric release valve 22 to an attaching plate 31 made of a metal. Therefore, the pressurizing unit 18 is integrated to the main body case 2 by attaching the attaching plate 31 to the main body case 2 by a plurality of screws or the like. Rotation of the pump motor 28 is transmitted to the pump portion 30 by being converted into reciprocal linear movement by way of a gear mechanism 32 and a cam mechanism 33.

Explaining the gear mechanism 32 and the cam mechanism 33 as follows, for example, a small-sized DC motor is used for the pump motor 28, and a motor gear 34 is fixedly attached to an output shaft thereof. Meanwhile, an end edge of the attaching plate 31 is folded to form with a wall portion 31*a* erected vertically from a bottom wall of the attaching plate 31, and the wall portion 31*a* is integrally formed with a first support shaft 35 to extend to a side of the pump motor 28. A root of the first support shaft 35 is constituted by a large diameter and a front end side thereof is constituted by a small diameter, and a first gear 36 is supported by the small diameter portion of the first support shaft 35 in a rotatable state. The first gear 36 includes a large diameter gear 36*a* and a small diameter gear 36*b* and the large diameter gear 36*a* is brought in mesh with the motor gear 34. Further, the pump motor 28 corresponds to a drive motor and the gear mechanism 32 and the cam mechanism 33 constitute a converting mechanism.

The pump portion 30 is provided with a diaphragm (bellows) 37 one end of which is opened in a circular shape, and a lid portion 38 for closing an opening portion 37*a* (refer to FIG. 7 and FIG. 8) of the diaphragm 37 in a hermetically closed state. Therefore, inside of the diaphragm 37 closed by the lid portion 38 functions as the pump chamber 29. The diaphragm 37 is constituted by a bellows of the shape in which a side wall thereof is folded back by a plurality of times and is fabricated by forming a resin or the like by blow forming. The diaphragm 37 is elongatable and contractable in a longitudinal direction (arrow mark A direction shown in FIG. 4) by constituting the drive source by the pump motor 18 and a volume of the pump chamber 29 is increased and reduced in accordance with the expanding and contracting operation.

An end face of the lid portion 38 is formed with a plurality (3 in this example) of claw portions 38*a*. Meanwhile, at a position opposed to the end face of the lid portion 38, the attaching plate 31 is folded to form with a holding wall 31*b* erected vertically from the bottom wall of the attaching plate 31. A center portion of the holding wall 31*b* is formed with a locking hole 31*c* in a circular shape. A base end side, (that is, a side of the lid portion 38) of the pump portion 30 is fixed to the attaching plate 31 by locking the claw portion 38*a* by the locking hole 31*c*. Other end of the diaphragm 37 is attached with a pressing member 39 for expanding and contracting the diaphragm 37 by linearly moving to reciprocate based on rotational movement of the pump motor 28.

Figure 5:
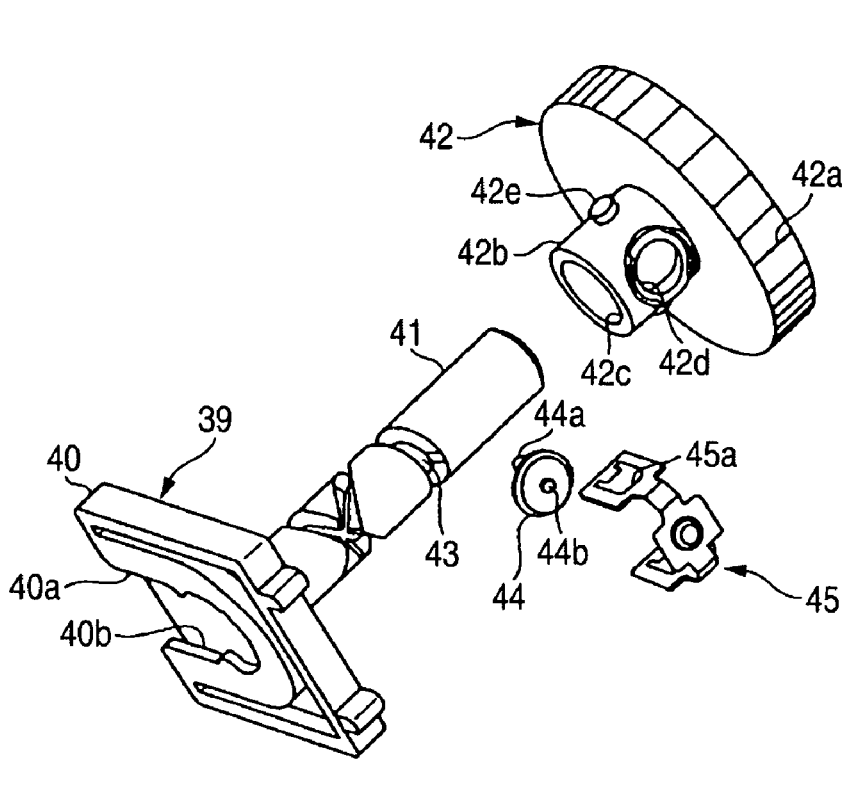
FIG. 5 is a perspective view of a transmitting member and parts related thereto.
Figure 6:
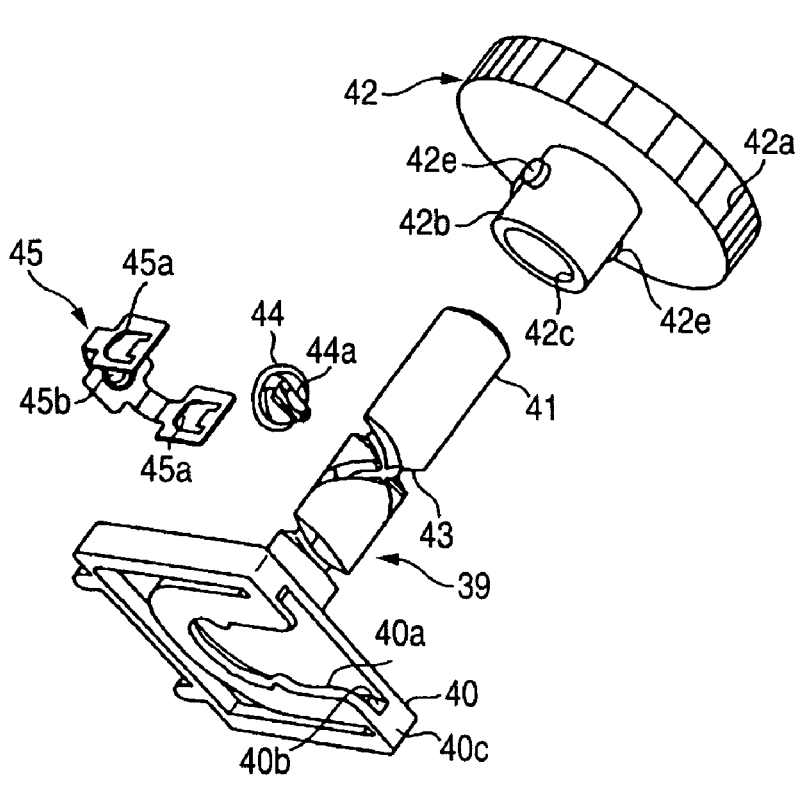
FIG. 6 is a perspective view viewing FIG. 5 from an opposed side.

FIG. 5 is a perspective view of the pressing member 39 and parts related thereto and FIG. 6 is a perspective view viewing FIG. 5 from an opposed side. The pressing member 39 is provided with a base portion 40 constituting a shape of a flat plate, and a piston 41 in a shape of a circular pillar integrally formed with the base portion 40. A rear face of the base portion 40 is formed with engaging pieces 40*a* extended in directions of being proximate to each other. The engaging pieces 40*a* are formed at a portion of the base portion excluding a side face 40*c* such that containing grooves 40*b* produced on inner sides of the engaging piece 40*a* are opened at the side face 40*c* of the base portion 40.

Meanwhile, an end portion of the diaphragm 37 is formed with an engaging portion 37*b* (refer to FIG. 7 and FIG. 8) in a shape of matching the containing groove 40*b*. The engaging portion 37*b* is brought into a state of being projected from an end portion (end face) of the diaphragm 37 and is formed in a shape of a step in which an outer side thereof is provided with a diameter larger than that of an inner side thereof to be able to be locked by the containing groove 40*b* of the pressing member 39. Therefore, the diaphragm 37 is integrated to the pressing member 39 by fitting the engaging portion 37*b* from the side face 40*c* of the base portion 40 of the containing groove 40*b*.

As shown by FIG. 3 and FIG. 4, the attaching plate 31 is folded to form with a pair of supporting pieces 31*d*, 31*d* at positions opposed to the piston 41. The supporting pieces 31*d*, 31*d* are extended vertically from the bottom wall of the attaching plate 31 and the respective supporting pieces 31*d*, 31*d* are formed with supporting holes 31*e*, 31*e* (refer to FIG. 4) at same height positions. The piston 41 of the pump portion 30 is inserted to the pair of supporting holes 31*e*, 31*e* in a state of capable of linearly moving to reciprocate, thereby, the piston 41 is brought into a state of being supported by the attaching plate 31.

As shown by FIG. 3 and FIG. 4, a second gear 42 capable of being rotated along with the first gear 36 is arranged between the pair of supporting pieces 31*d*, 31*d*. As shown by FIG. 5 and FIG. 6, the second gear 42 is provided with a teeth portion 42*a* of a large diameter portion and a cylindrical portion 42*b* of a small diameter portion. The second gear 42 is formed with a communication hole 42*c* communicated over both of the gear portion 42*a* and the cylindrical portion 42*b*. The gear portion 42*a* and the cylindrical portion 42*b* are disposed on the same axis. The second gear 42 is supported by the piston 41 to be able to rotate relative thereto by inserting the piston 41 to the communication hole 42*c*. Further, the gear mechanism 32 is constituted by the motor gear 34, the first gear 36 and the second gear 42. Further, the first gear 36 and the second gear 42 constitute a gear mechanism.

An outer peripheral face of the piston 41 is formed with a cam groove 43 in a shape of capable of converting rotational movement of the pump motor 28 into linear reciprocating movement of the piston 41. Meanwhile, a side wall of the cylindrical portion 42*b* is formed with a hole portion 42*d* in a circular shape and an outer peripheral face of the cylindrical portion 42*b* is formed with a pair of latching portions 42*e*, 42*e* in a state of interposing the hole portion 42*d*. The hole portion 42*d* is attached with a connecting piece 44 capable of being locked by the cam groove 43 of the piston 41 in a state of capable of being locked by the cam groove 43 of the piston 41 in a state of being positioned by a fixing piece 45 made of a metal substantially in a channel-like shape. Further, the cam mechanism 33 is constituted by the pressing member 39, the cam groove 43, the connecting piece 44 and the fixing piece 45.

A rear face of the connecting piece 44 is formed with a locking portion 44*a* capable of being locked by the cam groove 43 and a surface of the connecting piece 44 is formed with a projected portion 44*b*. Further, a pair of side walls of the fixing piece 45 are formed with locking holes 45*a*, 45*a* and a bottom wall thereof connecting the side walls is formed with a recess portion 45*b* (refer to FIG. 6) capable of locking the projected portion 44*b*. The connecting piece 44 is held in a state of being positioned by fitting the projected portion 44*b* of its own to the recess portion 45*b* of the fixing piece 45 and bringing the pair of locking portions 42*e* into a state of being latched by the latching holes 44*a* of the fixing piece 45 when the connecting piece 44 is disposed at the hole portion 42*d* of the cylindrical portion 42*b*.

The connecting piece 44 is positioned to fix by the fixing piece 45 in a state in which the locking portion 44*a* of its own is locked by the cam groove 43. Meanwhile, when the pump motor 28 is rotated, the first gear 36 and the second gear 42 are rotated along therewith and when the second gear 42 is rotated, also the connecting piece 44 is rotated along therewith. At this occasion, by the shape of the cam groove 43 by which the locking portion 44*a* of the connecting piece 44 is locked, rotational movement of the pump motor 28 is converted into linear reciprocal movement of the piston 41, the piston 41 is linearly reciprocated to move in accordance with rotation of the pump motor 28, and the diaphragm 37 is expanded (state of a bold line of FIG. 4) or contracted (state of a one-dotted line of FIG. 4).

Figure 7:
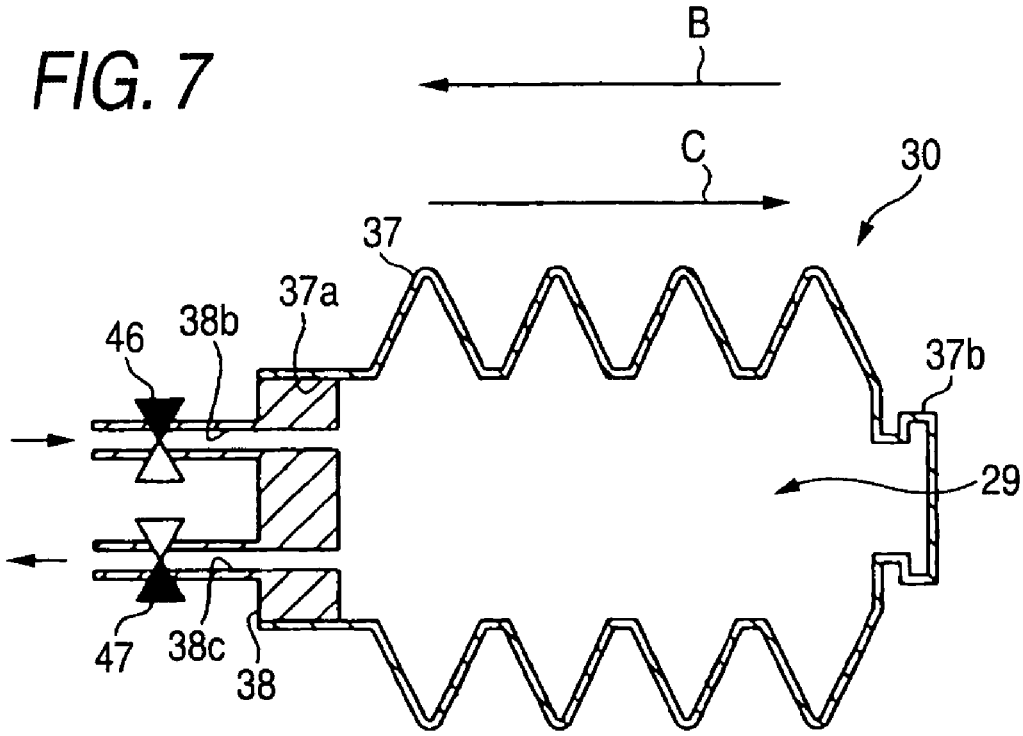
FIG. 7 is a side sectional view of a pump portion in a sucking state.
Figure 8:
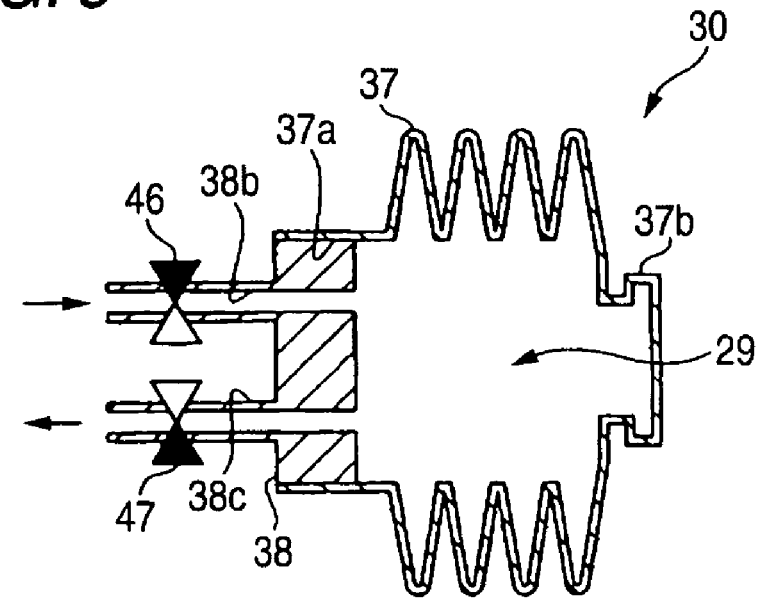
FIG. 8 is a side sectional view of the pump portion in a discharging state.

FIG. 7 and FIG. 8 are side sectional views of the pump portion 30. The lid portion 38 of the pump portion 30 is formed with a suction port 38*b* constituting a port of making the atmosphere flow into the pump chamber 29 and a discharge port 38*c* constituting a port of discharging pressurizing air in the pump chamber 29. The suction port 38*b* is connected with a one way valve 46 allowing only suction as a flow of air into the pump chamber 29 and the discharge port 38*c* is connected with a one way valve 47 allowing only discharge as a flow of air to outside of the pump chamber 29. Therefore, a pressurization amount is increased at each time of operating to expand and contract the diaphragm 37 by the check valve structure of the pump portion 30. Further, the one way valve 46 for suction and the one way valve 47 for discharge correspond to check valves.

When the piston 41 is linearly moved (reciprocated) to a side of the diaphragm 37 (arrow mark B direction shown in FIG. 7) in accordance with rotation of the pump motor 28, the diaphragm 37 is contracted from a state shown in FIG. 7 to a state shown in FIG. 8. At this occasion, the diaphragm 37 is brought into a discharging state and pressurizing air in the pump chamber 29 is supplied from the discharge port 38*c* to the ink cartridge 4. On the other hand, when the piston 41 is linearly moved (reciprocated) to a side opposed to the diaphragm (arrow mark C direction shown in FIG. 7) in accordance with rotation of the pump motor 28, the diaphragm 37 is expanded from the state shown in FIG. 8 to the state shown in FIG. 7. At this occasion, the pump chamber 29 is brought into a sucking state and air in the atmosphere is delivered from the suction port 38*b* into the pump chamber 29.

As shown by FIG. 3 and FIG. 4, the pressure sensor 21 is a sensor capable of detecting the pressure of pressurizing air discharged by the pump portion 30 and outputting a detected value in accordance with the pressure. The pressure sensor 21 is provided with an input connection tube 21*a* constituting an inlet of pressuring air and an output connection tube 21*b* constituting an outlet of intaken pressuring air. According to the pressure sensor 21, the inlet connection tube 21*a* is connected to a discharge connection tube 30*a* of the pump portion 30 via a first air supply tube 19*a* and the output connection tube 21*b* is connected to a suction connection tube 22*a* of the atmospheric release valve 22 via a second air supply tube 19*b*.

Figure 9:
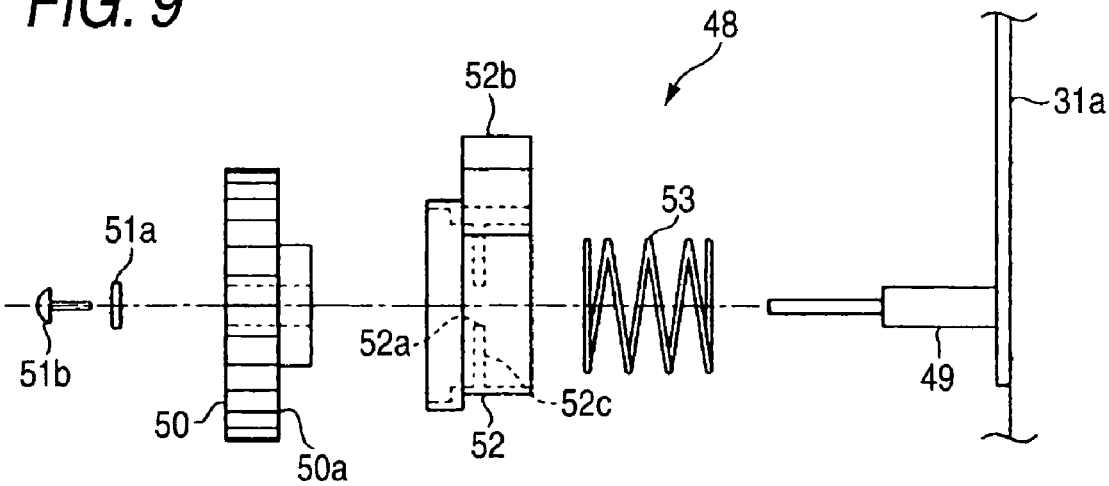
FIG. 9 is a plane view showing a disassembled state of a clutch mechanism.

FIG. 9 is a plane view showing a disassembled state of a friction clutch mechanism. A friction clutch mechanism 48 is arranged between the first gear 36 and the atmospheric releasing valve 22. Explaining the friction clutch mechanism 48 as follows, a second support shaft 49 is fixedly attached to the wall portion 31*a* of the attaching plate 31. A root of the second support shaft 49 is constituted by a large diameter and a front end side thereof is constituted by a small diameter and a third gear 50 is rotatably attached to a small diameter portion of the second support shaft 49. A front end of the second support shaft 49 is fixedly attached with a fixing pin 51*b* via a washer 51*a*, and the third gear 50 is held in a state of being prevented from drawing off from the second support shaft 49 by the fixing pin 51*b*. Further, the atmospheric release valve 22 and the friction clutch mechanism 48 constitute a valve mechanism.

The third gear 50 is brought in mesh with the small diameter gear 36*b* of the first gear 36. A driven part 52 rotatable along with the third gear 50 by the friction clutch mechanism 48 is attached between the third gear 50 and the wall portion 31*a*. The driven part 52 is provided with a through hole 52*a* at a center portion thereof and is supported rotatably by the second support shaft 49 by inserting the large diameter portion of the second support shaft 49 to the through hole 52*a*. A side face of the driven part 52 is formed with a pressing portion 52*b* projected in a side direction to be larger than an outer diameter of the driven part. A length of projecting the pressing portion 52*b* is set to a length reaching the atmospheric release valve 22.

A spring (hereinafter, described as first spring) 53 for urging the driven part 52 to a side of the third gear 50 is interposed between the driven part 52 and the wall portion 31*a*. The first spring 53 is brought into a state of bringing one end thereof into contact with a side of the wall portion 31*a* and bringing other end thereof into contact with an inner wall 52*c* of the driven part 52. The third gear 50 and the driven part 52 are brought into a state of being brought into contact with each other by a press force in accordance with an urge force of the first spring 53 and a wall face of the third gear 50 brought into contact with the driven part 52 functions as a clutch face 50*a*. Further, a speed reduction ratio between the third gear 50 and the driven part 52 by the friction clutch is set to be larger than a speed reduction ratio between the first gear 36 and the second gear 42.

When the pump motor 28 is rotated, the third gear 50 is rotated via the first gear 36, the friction clutch mechanism 48 is operated in accordance with the rotational operation and the driven part 52 is rotated in a direction the same as that of the third gear 50. Incidentally, since the pump motor 28 can be rotated regularly and rotated inversely, in this example, when the pump motor 28 is rotated regularly, the driven part 52 is rotated to a side opposed to the atmospheric release valve 22 (that is, arrow mark D direction shown in FIG. 3) and when the pump motor 28 is rotated inversely, the driven part 52 is rotated to a side of the atmospheric release valve 22 (that is, arrow mark E direction shown in FIG. 3). Further, the friction clutch mechanism 48 is constituted by the third gear 50, the driven part 52 and the first spring 53.

Figure 10:
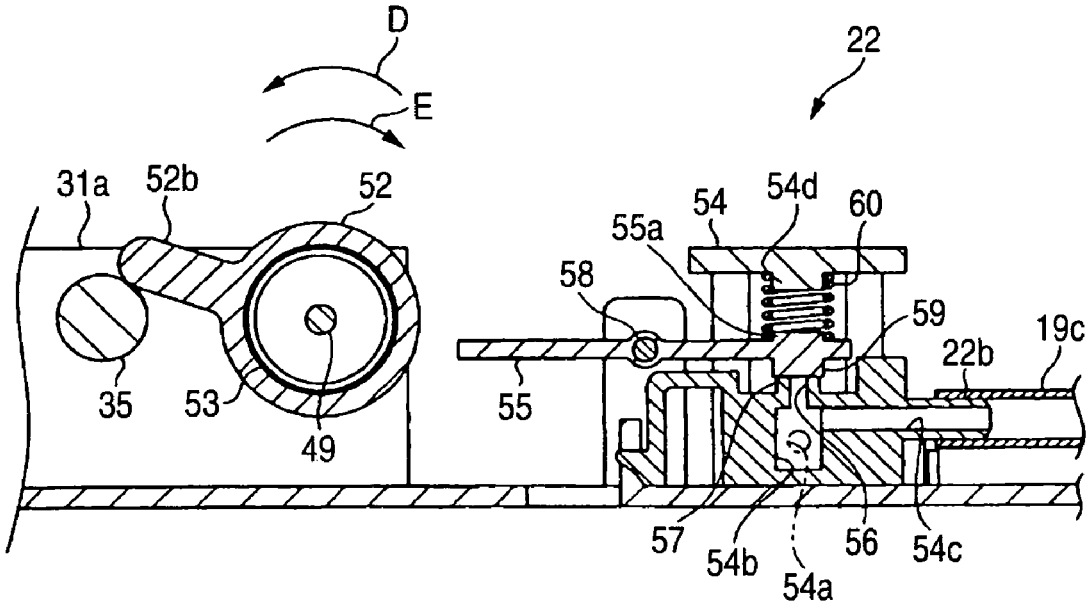
FIG. 10 is a sectional view of an atmospheric release valve in a closed state.
Figure 11:
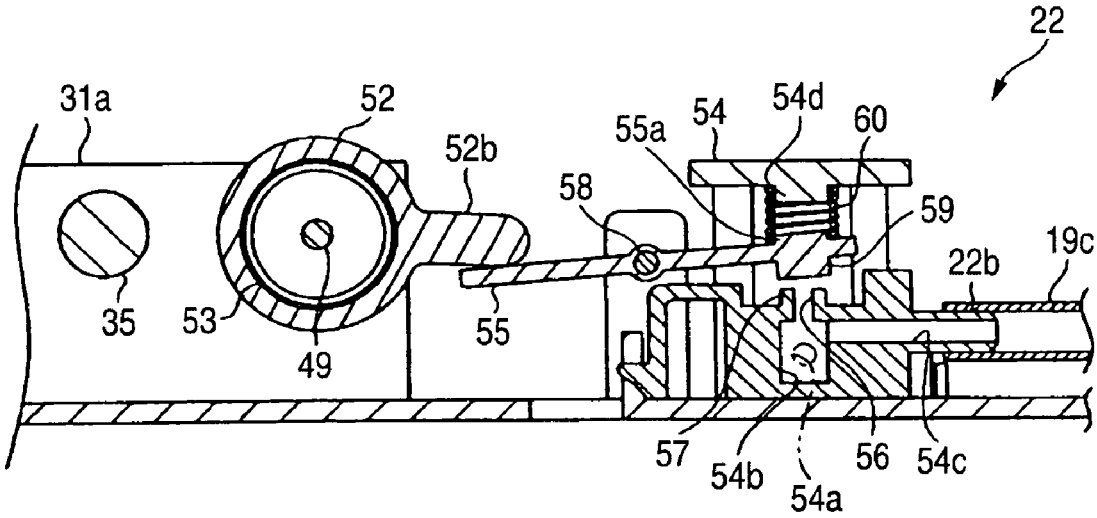
FIG. 11 is a sectional view of the atmospheric release valve in an opened state.
Figure 12:
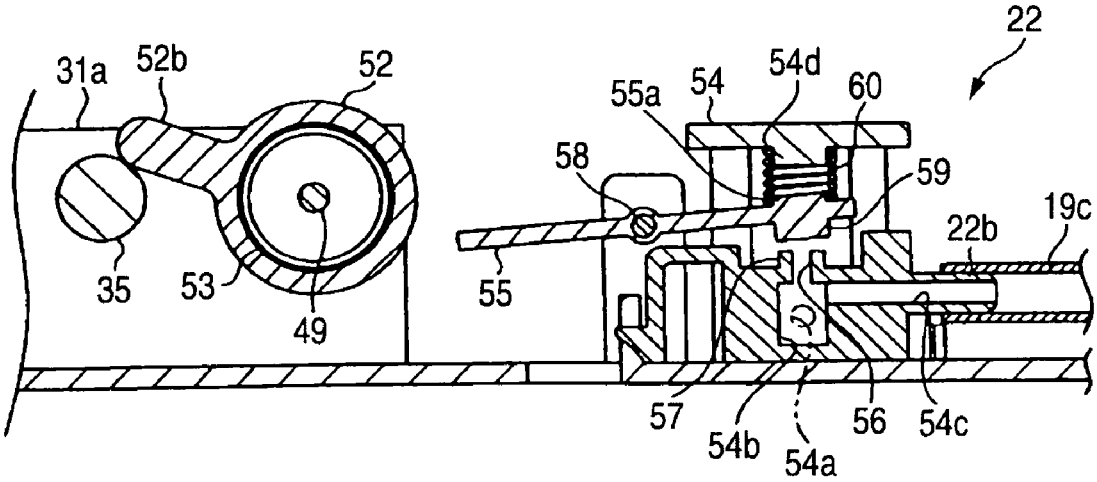
FIG. 12 is a sectional view of the atmospheric release valve brought into the opened state by itself.

FIG. 10 through FIG. 12 are sectional views showing states of operating the atmospheric release valve 22. The atmospheric release valve 22 is a valve having two functions of an atmospheric releasing function and a regulator function and is provided with a valve main body 54 having a path of pressurizing air, and a valve opening lever 55 for opening and closing the atmospheric opening valve 22. The valve main body 54 is provided with a suction port 54*a* constituting an inlet of pressurizing air delivered from the pressurizing pump 20 via the pressure sensor 21, a valve chamber 54*b* functioning as a chamber for detecting pressure of pressurizing air in the valve, and a discharge port 54*c* constituting an outlet of pressuring air in the valve.

The valve main body 54 is formed with a valve hole 56 for communicating the valve chamber 54*b* and outside of the chamber (atmosphere) and a valve seat 57 is formed at a peripheral edge of an outlet of the valve 56. The valve main body 54 is installed with a rotating shaft 58 extended along an axial direction of the second support shaft 49 and the valve opening lever 55 is pivotally supported by the rotating shaft 58. A valve element 59 capable of opening and closing the valve hole 56 is projected to form at a face of a front end of the valve opening lever 55 on a side of the valve hole 56.

On the other hand, a spring (hereinafter, described as second spring) 60 for urging the front end of the valve opening lever 55 to a side of the valve 56 is interposed between an upper wall of the valve main body 54 and the valve opening lever 55. Spring receivers 54*d*, 55*a* for locking the second spring 60 are respectively formed at a lower face of the upper wall of the valve main body 54 and a face of the front end of the valve opening lever 55 on a side opposed to the valve hole 56. A discharge connection tube 22*b* of the atmospheric release valve 22 is connected with a third air supply tube 19*c* extended from the divider 23. Further, the valve opening lever 55 corresponds to a lever member and the second spring 60 corresponds to an urging member.

In a normal state, (that is, in regularly rotating the pump motor 28), as shown by FIG. 10, the front end of the valve opening lever 55 is inclined to a lower side by being exerted with the urge force of the second spring 60, the valve element 59 of the valve opening lever 55 closes the valve hole 56 and therefore, the atmospheric release valve 22 is brought into a closed state. Although at this occasion, the driven part 52 is rotated in the arrow mark D direction of FIG. 10 by regularly rotating the pump motor 28, even when the pump motor 28 continues to rotate regularly, the driven part 52 is brought into contact with the first support shaft 35 after a while to restrain rotation thereof to be brought into a state of not rotating further.

The pressurizing pump 20 is switched between a stationary state and a driving state in operation thereof based on a pressure value P calculated from a detected value of the pressure sensor 21. That is, the pressurizing pump 20 is brought into the stationary state to temporarily stop driving the pump when the pressure value P becomes not less than a set pressure Pa after starting to drive the pump and restarts to drive the pump by starting to regularly rotate the pump motor 28 when the pressure value P becomes lower than the set pressure Pa. Further, by repeating the processing, pressurizing air supplied to the ink cartridge 4 is maintained to a pressure value of a predetermined range.

On the other hand, when the pressure value P is excessively increased to be not less than a threshold Pb (>Pa), the atmospheric releasing function of the atmospheric release valve 22 is operated. At this occasion, the pump motor 28 is started to rotate inversely instead of being rotated regularly and the driven part 52 is started to rotate in the arrow mark E direction of FIG. 10 in accordance therewith. When the driven part 52 is rotated for a while in the arrow mark E direction, as shown by FIG. 11, the pressing portion 52*b* of the driven part 52 is brought into contact with a base end of the valve opening lever 55 and the base end of the lever is pressed to a lower side. Then, the valve opening lever 55 is pivoted against the urge force of the second spring 60, a front end of the lever is lifted to an upper side and the valve element 59 is separated from the valve hole 56 and the atmospheric release valve 22 is brought into an opened state.

Further, the atmospheric release valve 22 is provided also with the regulator function for preventing pressurizing air in the air supply tube 19 from being brought under an excessive pressure even when the pressure sensor 21 or the control system of the printing apparatus 1 is failed (run wild). Explaining the regulator function as follows, a threshold Pc (>Pb) to operate the regulator function is set in accordance with a spring force (urge force) of the second spring 60. Therefore, when the pressure value P of pressurizing air becomes not less than the threshold Pc, as shown by FIG. 12, the front end of the lever is lifted to the upper side by an air pressure in the valve chamber 54*b* to bring about the opened state by itself.

Further, even when a power source of the printing apparatus 1 is made OFF, the atmospheric releasing function of the atmospheric release valve 22 is operated. This is because when inside of the air supply tube 19 stays to be in a pressurized state in the case of a state of making the power source of the printing apparatus 1 OFF, there poses a problem that the ink cartridge 4 is difficult to be taken out or ink leaks out from a clearance of the ink discharge port 15*a*. Therefore, when the power source of the printing apparatus 1 is made OFF, a state of supplying the power source to a power source circuit is maintained for a predetermined period of time by using a delay circuit or the like and the atmospheric release valve 22 is brought into the opened state by inversely rotating the pump motor 28 during the time period.

As shown by FIG. 4, at a vicinity of the pressing member 39, an attaching plate 31 is attached with a home detector 61 for detecting a position X of expanding and contracting the diaphragm 37. The home detector 61 is a detector for detecting whether the diaphragm 37 is brought into a maximally expanded state (that is, disposed at home position (home position) X0) for detecting whether the diaphragm 37 is disposed at the home position X0 by viewing a position of the pressing member 39.

As the home detector 61, for example, a limit switch, an optical sensor or the like is used. The home detector 61 is provided with a detecting lever 61*a* pivotable relative to a main body of the detector and the detecting lever 61*a* is arranged on a path of moving the base portion 40. When the diaphragm 37 is disposed at the home position X0, the base portion 40 is brought into a state of pressing the detecting lever 61*a* and the home detector 61 is brought into an ON state to thereby to output a detecting signal. Further, the home detector 61 corresponds to a position detecting device.

Figure 13:
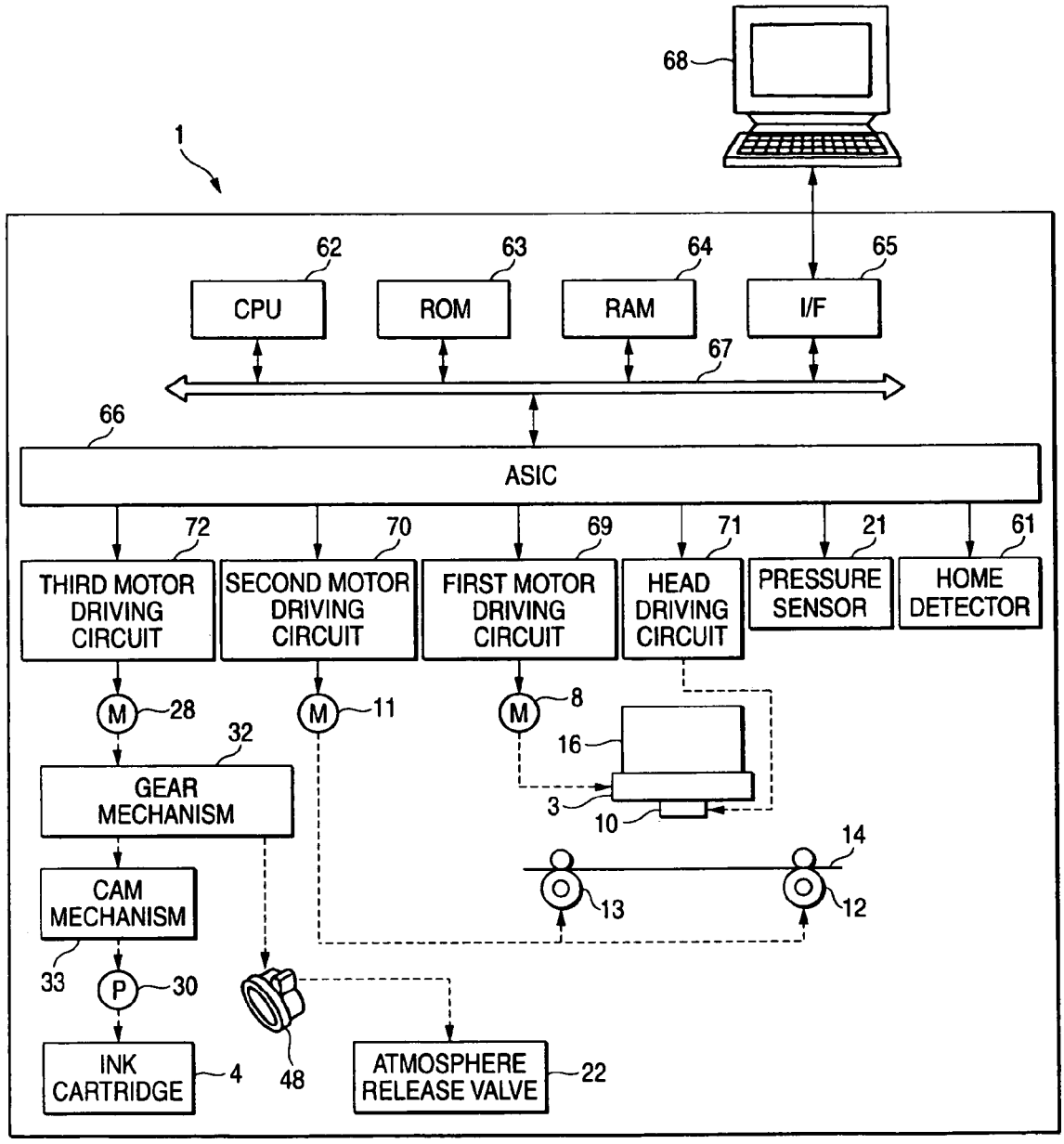
FIG. 13 is a block diagram showing an electric constitution of a printing apparatus.

FIG. 13 is a block diagram showing an electric constitution of the printing apparatus 1. The printing apparatus 1 is provided with CPU 62, ROM 63, RAM 64, I/F 65 and ASIC 66 and the devices are electrically connected by way of a bus 67. CPU 62 governs a main control of the printing apparatus 1 and is operated by constituting a work area by RAM 64 based on a control program stored to ROM 63. Further, the printing apparatus 1 is connected to a host computer 68 via I/F 65 and executes a printing processing based on printing data transmitted from the host computer 68. Further, CPU 62 and ASIC 66 constitute a calculating unit, a control unit, a pressurizing operation controlling unit and a pressurization releasing controlling unit.

ASIC 66 is operated based on an instruction from COU 62 and controls to drive a carrying motor 8 via a first motor driving circuit 69 and a recording head 10 via a head driving circuit 71. ASIC 66 is electrically connected to the pressure sensor 21 and calculates the pressure value P of pressurizing air based on the detected value from the pressure sensor 21. Further, ASIC 66 controls to drive the pump motor 28 via a third motor driving circuit 72 based on a calculated pressure value P. Further, ASIC 66 is electrically connected to the home detector 61 and determines that the diaphragm 37 is disposed at the home position X0 when the detecting signal is inputted from the home detector 61.

Now, when the printing apparatus 1 starts printing, pressurizing operation by the pressurizing pump 20 is started for delivering ink at inside of the ink cartridge 4 to the subatank 16. ASIC 66 successively calculates the pressure value P of pressurizing air based on the detected value of the pressure sensor 21, stops the pump motor 28 when the pressure value P becomes not less than the set pressure Pa after starting to drive the pump and rotates the pump motor 28 again when the pressure value P becomes lower than the set pressure Pa. ASIC 66 maintains pressurizing air to the pressure in the predetermined range by repeating to drive or stop the pressurizing pump 20.

Figure 14:
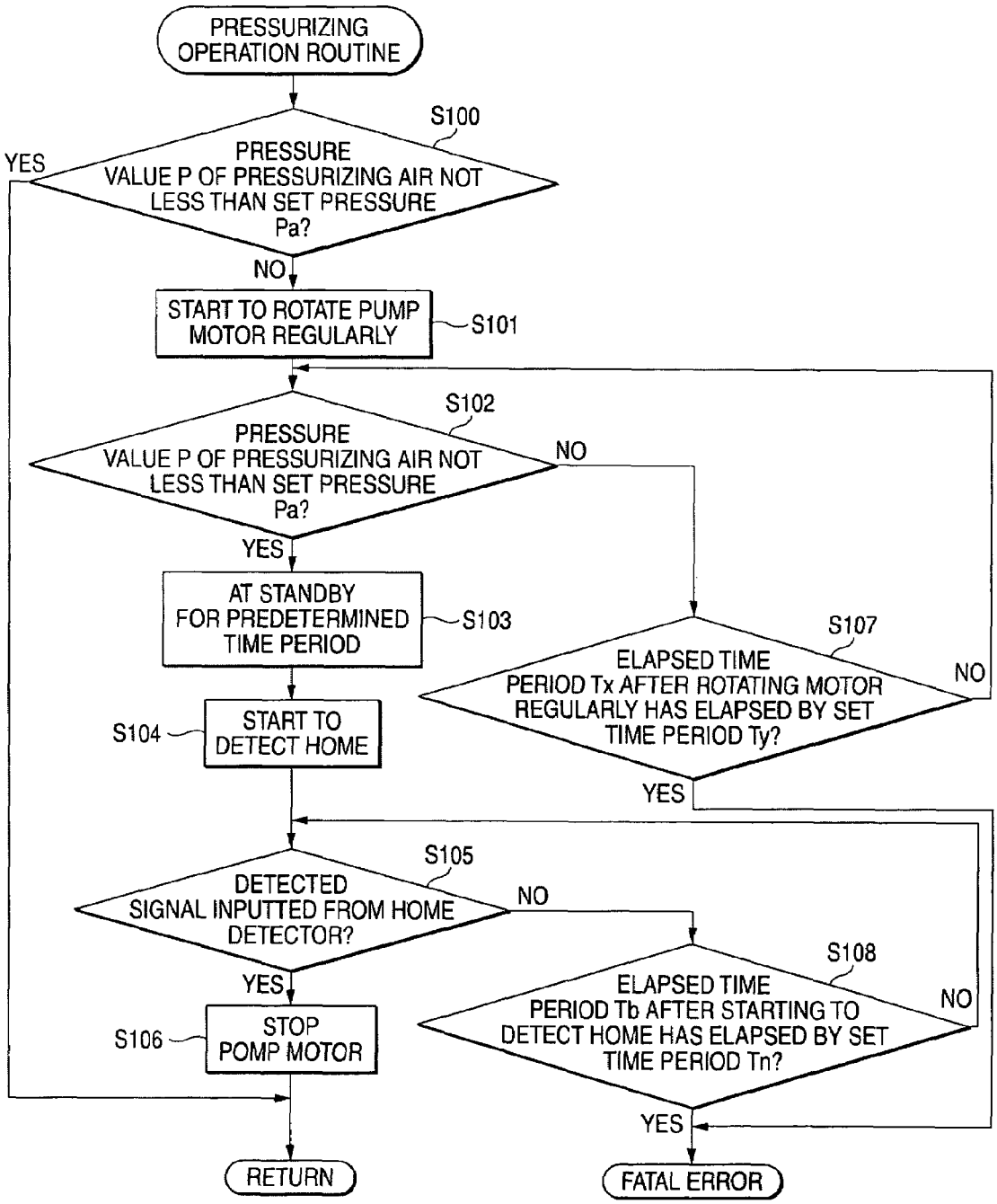
FIG. 14 is a flowchart executed by ASIC in a pressurizing operation.

The pressurizing operation will be explained in accordance with a flowchart shown in FIG. 14.

At step 100, it is determined whether the pressure value P of pressurizing air becomes not less than a set value Pa (whether pressure value≧set pressure Pa is established). That is, the pressure value P of pressurizing air is calculated based on the detected value from the pressure sensor 21 and it is determined whether the pressure value P is not less than the set pressure Pa. When the pressure value P is less than the set pressure Pa, it is determined that the pressurizing operation is to be executed to proceed to step 101 and when the pressure value P is not less than the set pressure Pa, it is determined that the pressurizing operation is not needed to finish the flowchart.

At step 101, the pump motor 28 is regularly rotated. Therefore, regular rotation of the pump motor 28 is transmitted to the cam mechanism 33 by way of the gear mechanism 32 and rotation of the pump motor 28 is converted into linear reciprocating movement of the pressing member 39 by the cam mechanism 33. Further, pressurizing air is discharged from the pump chamber 29 by operating to expand and contract the diaphragm 37 and the pressure value P of pressurizing air is gradually increased at each time of repeating to operate to expand and contract the diaphragm 37.

At step 102, it is determined whether the pressure value P of pressurizing air is not less than the set pressure Pa. Here, when the pressure value P becomes not less than the set pressure Pa, it is determined that the pressuring operation is executed normally to proceed to step 103. On the other hand, when the pressure value P does not become not less than the set pressure Pa, the operation proceeds to step 107.

At step 103, the operation is at standby in a state as it is during a predetermined time period Tk. That is, the operation is at standby in the state as it is during the predetermined time period Tk before proceeding to successive operation. The predetermined time period Tk is provided with a value not less than a time period necessary for reciprocating the pressing member 39 at least by one reciprocation and is set to a value not less than 1 second when, for example, about 1 second is taken for reciprocating the pressing member 39 by one reciprocation.

At step 104, detecting of home for determining whether the diaphragm 37 is disposed at the home position X0 is started.

At step 105, it is determined whether the detecting signal is inputted from the home detector 61. Here, when the detecting signal is inputted from the home detector 61, it is determined that the diaphragm 37 is disposed at the home position X0 to proceed to step 106. On the other hand, when the detecting signal is not inputted from the home detector 61, the operation proceeds to step 108.

At step 106, the pump motor 28 which is being rotated regularly is stopped. Therefore, the expanding and contracting operation of the pressurizing pump 20 is stopped in a state in which the diaphragm 37 is disposed at the home position X0, that is, in a state in which the diaphragm 37 is maximally expanded. Thereafter, by executing the flowchart again and repeatedly executing the flowchart, pressurizing air is maintained at a pressure value in a predetermined range.

Further, when it is determined that the pressure value P is less than the set value Pa at step 102, at step 107, it is determined whether an elapsed time period Tx after regularly rotating the motor has elapsed by a set time period Ty (whether elapsed time period Tx>set time Ty is established). Here, when the elapsed time period Tx has not elapsed by the set time period Ty, it is determined that the diaphragm is being pressurized to return to S102.

Meanwhile, when the elapsed time period Tx has elapsed by the set time period Ty, it is determined that an abnormality is brought about somewhere of the apparatus to inform a fatal error. For example, the abnormality of the apparatus is that the pump motor 28 is not rotated, or the diaphragm 37 is perforated or the like. Since the printing apparatus 1 is mounted with a display screen (LCD, monitor), a display lamp (LED) and a buzzer (including a speaker or the like), the fatal error is informed by at least any one of the display screen, the display lamp and the buzzer.

Further, when it is determined that the detecting signal is not inputted from the home detector 61 at step 105, at step 108, it is determined whether an elapse time period Tb from starting to detect input of the detecting signal has elapsed by a set time period Tn (whether elapsed time period Tb>set time period Tn is established). When the elapsed time period Tb has not elapsed by the set time period Tn, the operation returns to step 105 to continue to detect input of the detecting signal and when the elapsed time period Tb has elapsed by the set time period Tn, it is determined that an abnormality is brought about in the apparatus to inform the fatal error.

Meanwhile, depending on a state of operating the printing apparatus 1, there is also conceivable a case in which the pressure for pressurizing air in the air supply tube 19 is increased excessively against intention. As a cause of excessively increasing the pressure, for example, there is a temperature rise of the printing apparatus 1 per se by using the printing apparatus 1 for a long period of time. ASIC 66 determines that the pressure of pressuring air is excessively increased when the calculated pressure value P of pressurizing air becomes not less than the threshold Pb. Therefore, ASIC 66 executes pressurization releasing operation for lowering the pressure in the air supply tube 19, that is, operation of opening atmospheric release valve 22.

Figure 15:
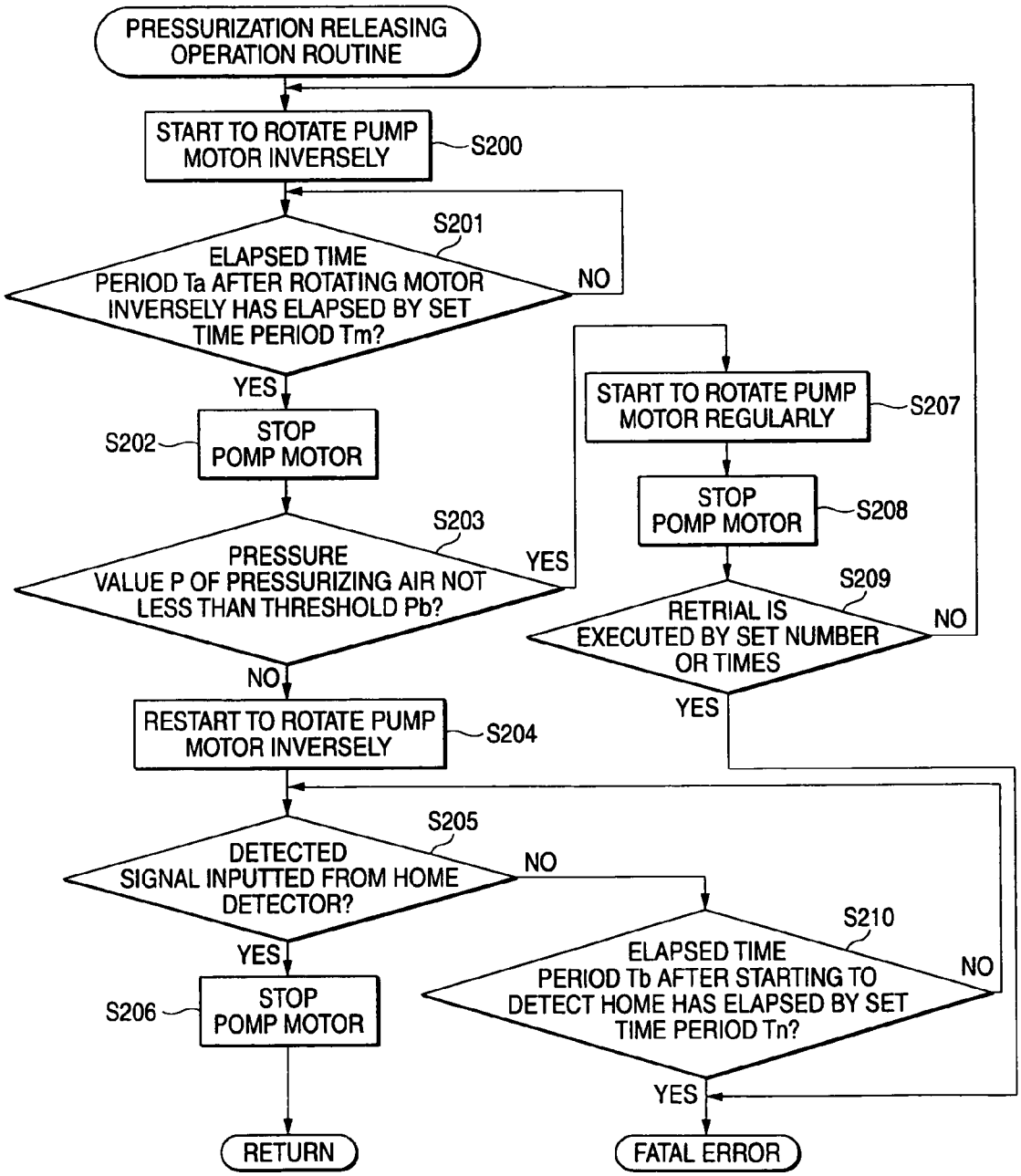
FIG. 15 is a flowchart executed by ASIC in a pressurization releasing operation.

Next, pressurization releasing operation executed by ASIC 66 will be explained in reference to a flowchart shown in FIG. 15. ASIC 66 executes the flowchart when the pressure value P of pressurizing air exceeds the threshold Pb as a trigger.

At step 200, the pump motor 28 is rotated inversely. Therefore, the driven part 52 starts rotating from the state shown in FIG. 10 in an arrow mark E direction of the drawing in accordance with inverse rotation of the pump motor 28.

At step 201, it is determined whether an elapsed time period Ta after inversely rotating the motor has elapsed by a set time period Tm (whether elapsed time period Ta>set time period Tm is established). Here, when the driven part 52 is rotated regularly, as shown by FIG. 11, the pressing portion 52*b* of the driven part 52 moves down the valve opening lever 55 to bring about a state of opening the atmospheric release valve 22. Therefore, pressurizing air in the air supply tube 19 is discharged to outside to resolve an excessively pressurized state. When the elapsed time period Ta>set time period Tm is established, the operation proceeds to step 202 and when the elapsed time period Ta>set time period Tm is not established, the operation is at standby as it is.

At step 202, the pump motor 28 which is being rotated inversely is stopped.

At step 203, it is determined whether the pressure value P of pressurizing air is not less than the threshold Pb (whether pressure value P≧threshold Pb). Here, when the pressure value P of pressurizing air is lower than the threshold Pb, there is brought about a state in which air is released to the atmosphere normally by the atmospheric release valve 22 and the operation proceeds to step 204. On the other hand, when a state in which the pressure value of pressurizing air stays to be not less than the threshold Pb is continued, there is brought about a state in which air is not released to the atmosphere normally by the atmospheric release valve 22, and the operation proceeds to step 207.

At step 204, inverse rotation of the pump motor 28 is restarted. Here, even when the pump motor 28 is rotated inversely, the linear reciprocating movement of the piston 41 is executed and therefore, by restarting inverse rotation of the pump motor 28, the diaphragm 37 is disposed at the home position X0. Further, although in restarting to rotate the pump motor 28 inversely, the pressing portion 52*b* is brought into a state of staying to be brought into the valve opening lever 55, since the friction clutch functions, rotation of the pump motor 28 is permitted.

At step 205, it is determined whether the detecting signal is inputted from the home detector 61. Here, when the detecting signal is inputted from the home detector 61, it is determined that the diaphragm 37 is disposed at the home position X0 to proceed to step 206 and when the detecting signal is not inputted from the home detector 61, it is determined that the diaphragm 37 is not disposed at the home position X0 to proceed to step 210.

At step 206, the pump motor 28 is stopped. Therefore, the pressurizing pump 20 stops expanding and contracting operation in a state in which the diaphragm 37 is disposed at the home position X0, that is, a state in which the diaphragm 37 is expanded maximally.

On the other hand, when it is determined that the pressure value P≧the threshold Pb is established at step 203, the pump motor 28 is rotated regularly at step 207. Therefore, the driven part 52 starts rotating in the arrow mark D direction shown in FIG. 10 and the pressing portion 52*b* of the driven part 52 is returned to a position separated from the pump opening lever 55.

At step 208, the pump motor 28 which is being rotated regularly is stopped.

At step 209, it is determined whether retrial is executed by a set number of times. Meanwhile, when the pressure value P is not lowered even by rotating the pump motor 28 inversely, operation of temporarily rotating regularly and rotating inversely again the pump motor 28 (that is, atmospheric release by rotating the pump motor 28 inversely) is retried. The retrial is previously set to be able to execute by a predetermined number of times (set number of times), for example, when the set number of times is set to 3 times, it is determined whether a total number of times of retrial reaches 3 times.

Further, when the total number of times of retrial does not reach the set number of times, the operation returns to step 100 and releasing air to the atmosphere by inversely rotating the pump motor 28 is retried and when the total number of times of retrial reaches the set number of times, it is determined that an abnormality is brought about at somewhere of the apparatus (for example, the pump motor 28, the diaphragm 37 or the like) and a fatal error is informed. Since the printing apparatus 1 is mounted with a display screen (LCD, monitor), a display lamp (LED), a buzzer (including a speaker or the like), the fatal error is informed by at least any one of the display screen, the display lamp and the buzzer.

Meanwhile, when it is determined that the detecting signal is not inputted from the home detector 61 at step 205, at step 210, it is determined whether an elapsed time period Tb from starting to detect input of the detecting signal has elapsed by a set time period Tn (whether elapsed time period Tb>set time period Tn is established). When the elapsed time period Tb has not elapsed by the set time period Tn, the operation returns to step 205 to continue to detect input of the detecting signal and when the elapsed time period Tb has elapsed by the set time period Tn, the fatal error is informed.

Figure 16:
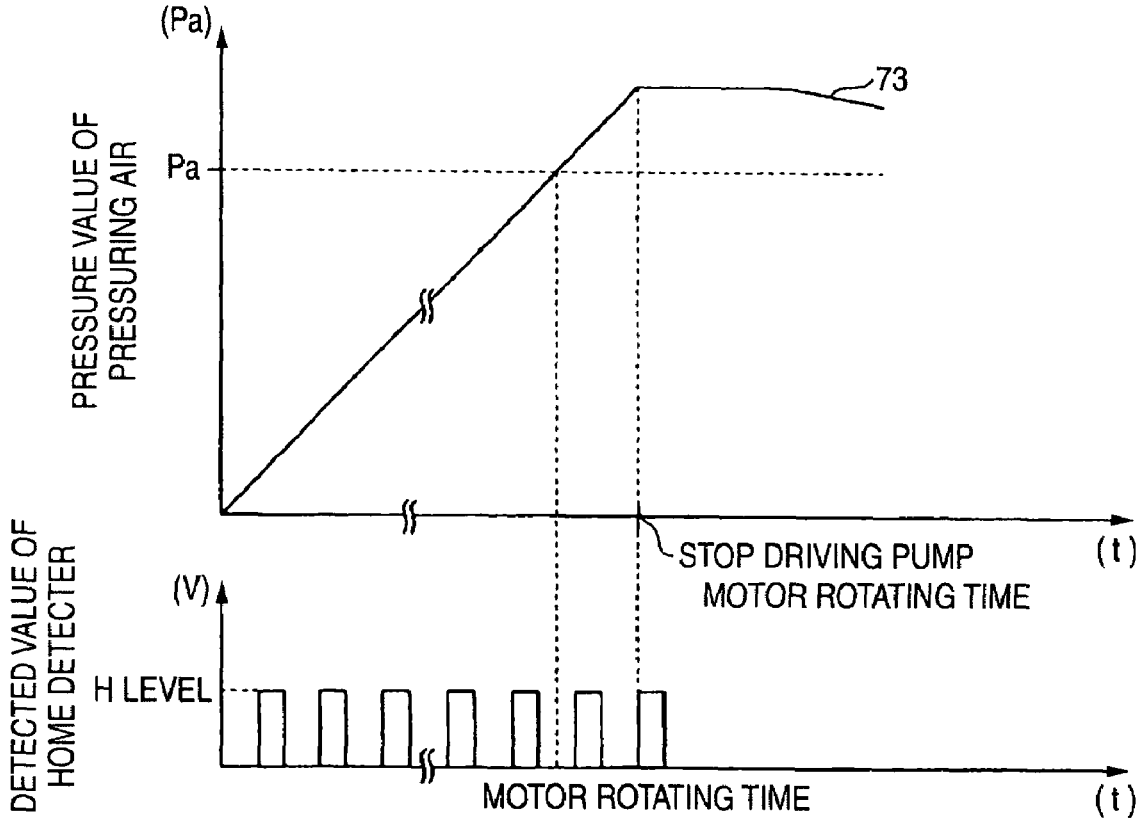
FIG. 16 illustrates waveform diagrams showing a change over time of a pressure value of pressurizing air and a change over time of an output value of a home detector.

Assume here that a value of a predetermined time period Tk is set to a time period necessary for reciprocating the pressing member 39 by one reciprocation. In this case, when a pressure waveform 73 of pressurizing air is shown in FIG. 16, even when the pressure value P reaches the set pressure Pa, the pump motor 28 is stopped after the diaphragm 37 is operated to expand and contract extraneously by one time. When additional pressurization is executed in this way, even when the pressure is reduced by a small amount of leakage of the air supply tube 19, an increase in a volume of the space 27 by consuming ink or the like, the pressure value P does not immediately become lower than the set pressure Pa. Therefore, it is not necessary to frequently repeat pressurizing operation and pressurization releasing operation, which can promote durability of the pump and simplify pressurization control.

Further, when the pressure value P becomes not less than the set pressure Pa, the pressurizing pump 20 is stopped and when the diaphragm 37 is disposed at the home position X0 after executing additional pressurization, the pump motor 28 is brought into a stationary state to stop the pressurizing pump 20. At this occasion, although when the diaphragm 37 is left in a contracted state for a long period of time, the diaphragm 37 is deformed by creep and a hindrance is brought about in the pressurizing force of the pressurizing pump 20. However, when the diaphragm 37 is disposed at the home position X0, the pressurizing pump 20 is brought into the stationary state and therefore, the problem of deformation by creep is not brought about and the pumping function is ensured for a long period of time.

According to the example, pressurizing operation of the pressurizing pump 20 is executed by regularly rotating the pump motor 28 and the pressurizing pump 20 is released from being pressurized by inversely rotating the pump motor 28. Therefore, pressurizing operation and pressurization releasing operation are switched by using the same motor and changing the rotational direction and therefore, for example, an electromagnetic valve having a large apparatus size needs not to use in opening and closing the atmospheric release valve 22 and small-sized formation of the pressurizing unit 18 and therefore, the printing apparatus 1 can be achieved. Further, a control of opening the atmospheric release valve 22 is carried out by the control of only rotating the pump motor 28 inversely and therefore, the control is carried out by a simple control.

Therefore, according to the first embodiment, the following effects can be achieved.

(1) Owing to the constitution of respectively executing operation of pressurizing the pressurizing pump 20 and operation of releasing the pressurizing pump 20 from being pressurized by switching the rotational direction of the same motor, an electromagnetic valve or the like needs not to use in opening and closing the atmospheric release valve 22 and the pressurizing unit 18 and therefore, the printing apparatus 1 can be downsized. Further, when the atmospheric release valve 22 is opened, the operation can be carried out by a simple control of rotating the pump motor 28 inversely and therefore, the control of opening the atmospheric release valve 22 is simplified.

(2) When the pressure value P of pressurizing air is successively calculated based on the detected value from the pressure sensor 21 and the pressure value P becomes not less than the threshold Pb, the atmospheric release valve 22 is controlled to the opened state by rotating the pump motor 28 inversely. Therefore, pressure of pressurizing air needs not to be increased excessively, the air supply tube 19 or the ink supply tube 17 is difficult to be brought into a situation of being destructed and durability of the pressurizing unit 18 and therefore, the printing apparatus 1 can be promoted.

(3) The suction port 38*b* of the pump portion 30 is provided with the one way valve 46 for suction and the discharge port 38*c* of the pump portion 30 is provided with the one way valve 47 to discharge. Therefore, there is constructed the constitution of elevating the pressurizing force of the diaphragm 37 in accordance with moving to expand and contract the diaphragm 37 and therefore, the sufficient pressing force can be achieved even when the diaphragm 37 is downsized, which further contributes to small-sized formation of the pressurizing pump 20 and therefore, the printing apparatus 1.

(4) A structure of opening and closing the atmospheric release valve 22 is a mechanical structure of bringing the pressing portion 52*b* into contact with the valve opening lever 55 by inversely rotating the pump motor 28, thereby, the valve opening lever 55 is pivoted and the atmospheric release valve 22 is brought into the opened state. Therefore, a structure of opening and closing the atmospheric release valve 22 is constituted by a simple structure.

(5) When the pressure value P of pressurizing air staying at the valve chamber 54*b* of the atmospheric release valve 22 becomes not less than the threshold Pc (>Pb), the valve opening lever 55 starts to be pivoted against the urge force of the second spring 60 and the atmospheric release valve 22 is automatically opened. Therefore, even when, for example, the pressure sensor 21 is failed or the control system of CPU 62 is failed, the atmospheric release valve 22 is opened automatically and therefore, pressure of pressurizing air is not elevated excessively and durability of the printing apparatus 1 is promoted.

(6) Since the friction clutch is used in the mechanism of transmitting rotation of the pump motor 28 to the driven part 52, in bringing the atmospheric release valve 22 to the opened state, even when the pump motor 28 continues to rotate after the pressing portion 52*b* is brought into contact with the valve opening lever 55, a hazard is not brought about. Therefore, control of the pump motor 28 is simplified and also a position detector or the like for viewing a rotational position of the pump motor 28 is not needed.

(7) When the friction clutch is used in the mechanism of transmitting rotation of the pump motor 28 to the driven part 52, also in operation of pressurizing the pressurizing pump 20 based on regular rotation of the pump motor 28, the driven part 52 is rotated along therewith. However, the speed reduction ratio between the third gear 50 and the driven part 52 by the friction clutch is set to be larger than the speed reduction ratio between the first gear 36 and the second gear 42 and therefore, a load other than a load necessary for pressurizing operation, that is, a load necessary for operating the pump portion 30 can be reduced.

(8) Even when the power source of the printing apparatus 1 is made OFF, the atmospheric release valve 22 is brought into the opened state by inversely rotating the pump motor 28 and therefore, in the state in which the power source is not applied to the printing apparatus 1, there is brought about the state in which pressurizing air is not filled in the air supply tube 19 and the ink cartridge 4. Therefore, when the power source is not supplied to the printing apparatus 1, inside of the air supply tube 19 or the ink cartridge 4 can be brought under the atmospheric pressure and the problem of leaking ink or the like can be made to be difficult to be posed.

(9) When the pump is released from being pressurized owing to excess pressure or when the power source of the printing apparatus 1 is made OFF, in finishing to release the pump from being pressurized, the operation is stopped in a state of maximally expanding the diaphragm 37 based on a result of detection of the home detector 61. Meanwhile, when the diaphragm 37 is left for a long period of time in a contracted state, the diaphragm 37 is deformed by creep and the pressurizing force is reduced, however, according to the example, the operation is stopped in a state of maximally expanding the diaphragm 37 and therefore, the diaphragm 37 is difficult to be deformed by creep or the like and the pressurizing pump 20 is difficult to be deteriorated by pressure.

(10) When the pressure is not lowered even by operating to open the atmospheric release valve 22 or when the diaphragm 37 is not disposed at the home position X0 in stopping the pressurizing pump 20, the fatal error is informed visually or by voice and therefore, a user can be informed that an abnormality is brought about in the printing apparatus 1.

(11) Even when the pressure value P for pressurizing air becomes not less than the set value Pa, the pressurizing operation is continued for the predetermined time period Tk to execute additional pressurization and therefore, even when the pressure is reduced by leaking air or consuming ink, there is not brought about a situation of restarting the pressurizing operation immediately. Therefore, it is not necessary to repeat the pressurizing operation and the pressurization releasing operation frequently and promotion of durability of the pump and simplification of pressurization control can be satisfied. Further, the position of the diaphragm 37 is started to detect after executing additional pressurization, the pump motor 28 is stopped when the diaphragm 37 is disposed at the home position X0 and therefore, the diaphragm 37 is stopped in a maximally expanded state and therefore, deformation by creep is difficult to be brought about and the pumping function can be ensured for a long period of time.

(12) The predetermined time period Tk is set to a value not less than a time period necessary for reciprocating the pressurizing member 39 at least by one reciprocation. Therefore, when additional pressurization is executed, the pressure of pressurizing air can be increased to a sufficient pressure value.

(13) In the case in which the pressure value P of pressurizing air is not increased even when the pump is started to drive in pressurizing operation, in the case in which the pressure is not reduced even when the atmospheric release valve 22 is operated to open in the pressurization releasing operation, or when the diaphragm 37 is not disposed at the home position X0 in finishing to operate the pressurization releasing operation, the fatal error is informed visually or by voice. Therefore, since that an abnormality is brought about in the printing apparatus 1 can be informed to a user.

Further, the embodiments are not limited to the above-described constitution but can be modified to the following modes.

Modified Example 1

Figure 21A:
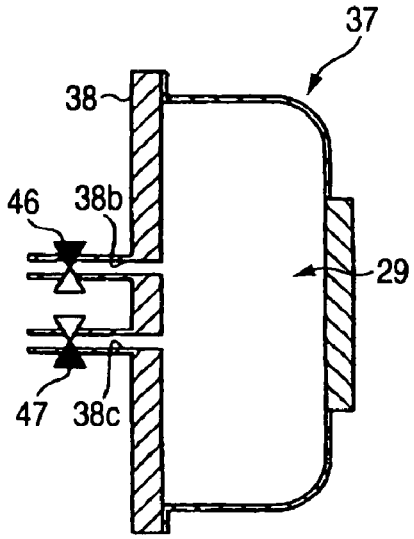
FIGS. 21A and 21B illustrate side sectional views of a pump portion according to other example.
Figure 21B:
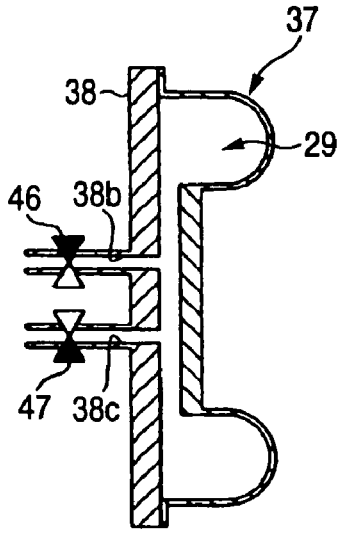

The diaphragm 37 is not limited to be constituted by the bellows shape but may be constituted by a bowl shape as shown by, for example, FIGS. 21A and 21B.

Modified Example 2

Figure 22A:
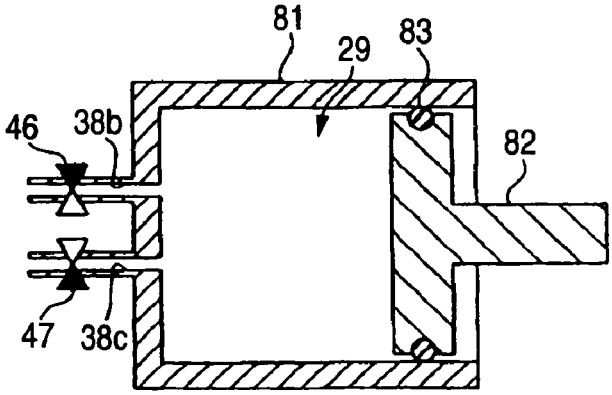
FIGS. 22A and 22B illustrate side sectional views of a pump portion according to still other example.
Figure 22B:
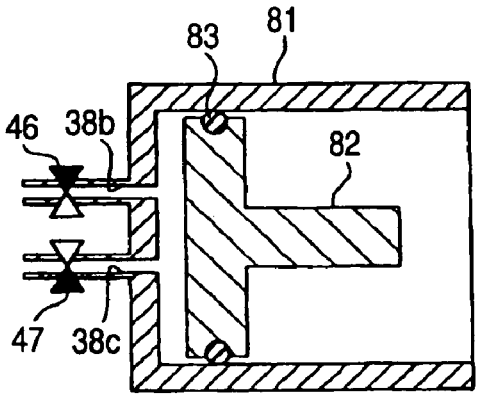
Figure 23:
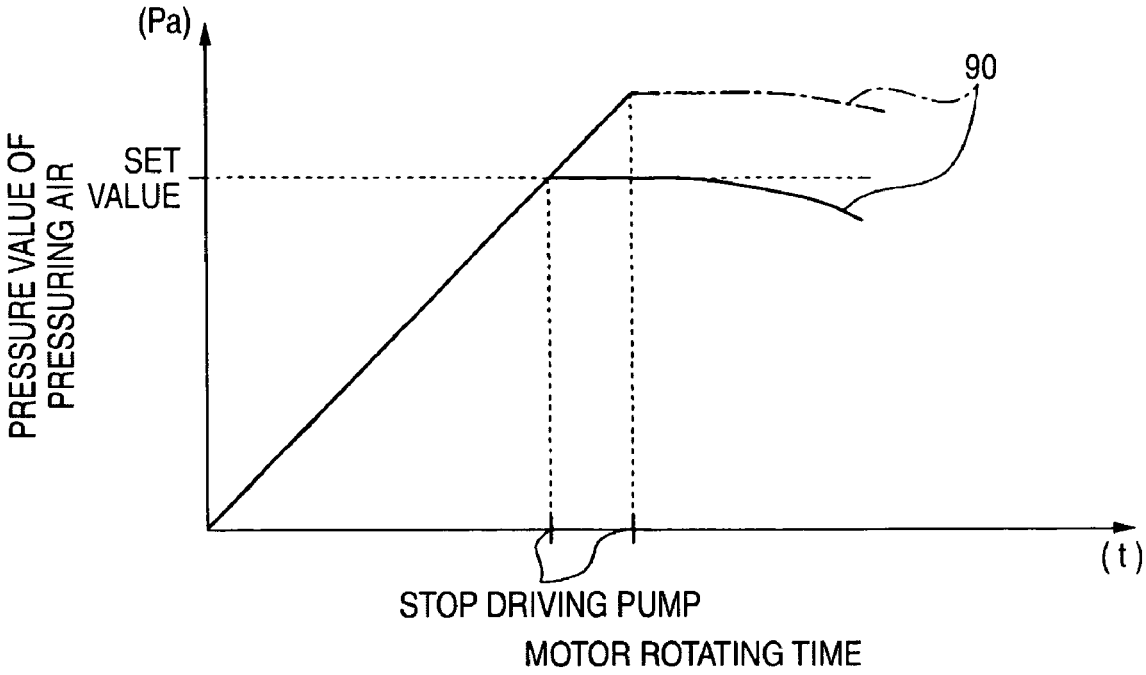
FIG. 23 is a waveform diagram showing a change over time of a pressure value of pressurizing air in a related art.

The pump portion 30 is not limited to be constituted by the structure of using the diaphragm 37 but a cylinder 81 shown by, for example, FIGS. 22A and 22B may be used. According to the structure, a piston 82 is reciprocally contained in the cylinder 81 and an O ring 83 is interposed between the piston 82 and an inner wall of the cylinder. Further, the volume of the pump chamber 29 is increased by reciprocating the piston 81 to discharge pressurizing air. Also in this case, so far as the cylinder 81 is constituted by a structure of connecting the one way valve 46 for suction and the one way valve 47 for discharge, even when the cylinder per se is small, a sufficient pressurization characteristic can be achieved and therefore, the pressurizing unit 18 and therefore, the printing apparatus 1 can be downsized.

Modified Example 3

The processing of detecting the home position after elapsing the predetermined time period Tk further from detecting the predetermined pressure by the pressure sensor 21 is not limited to be executed in the pressurizing operation but may be executed in the pressurization releasing operation. That is, when an explanation is given by using the flowchart shown in FIG. 15, after the pressure value P becomes lower than the threshold Pb at step 203, the operation may be at standby for the predetermined time period Tk and when the predetermined time period Tk has elapsed, the pump motor 204 may be restarted to rotate inversely at step 204. In this case, a time period of operating to open the valve can be prolonged and therefore, the pressurization releasing operation can further firmly be executed.

Modified Example 4

The pressure detector is not limited to the pressure sensor 21 for outputting the signal in accordance with the detected pressure value but may be a sensor of an ON/OFF type for outputting an ON signal when the predetermined pressure value is reached.

Modified Example 5

The position detecting device is not limited to the home detector 61 for outputting the ON signal when the diaphragm 37 is disposed at the home position X0 but may be a sensor capable of outputting a signal of a level in accordance with a state of expanding and contracting the diaphragm 37.

Modified Example 6

The value of the predetermined time period Tk is not particularly limited so far as the value is a value not less than the time period necessary for reciprocating the pressing member 39 at least by one reciprocation.

Modified Example 7

The pump motor 28 is not limited to the DC motor but an AC motor may be used therefor.

Modified Example 8

The mechanism for transmitting rotation of the pump motor 28 to the cam mechanism 33 and the friction clutch mechanism 48 is not limited to the gear mechanism 32 but rotation of the pump motor 28 may be transmitted to the cam mechanism 33 and the friction clutch mechanism 48 by, for example, a timing belt.

Modified Example 9

The cam mechanism 33 is not limited to the cylindrical cam of the embodiments but various methods of, for example, a heart cam, a front face cam, an end cam or the like may be adopted.

Modified Example 10

The mechanism for transmitting rotation of the pump motor 28 to the driven part 52 is not limited to the friction clutch mechanism 48 but the mechanism is not particularly limited so far as the mechanism is constituted by a structure of bringing the atmospheric release valve 22 to the opened state when the pump motor 28 is rotated inversely. Further, when the clutch mechanism is used for the mechanism, the clutch mechanism is not limited to the friction clutch but a mesh clutch or the like may be adopted.

Modified Example 11

The fluid supplied from the pressurizing pump 20 to the ink cartridge 4 is not limited to air but a liquid or the like may be used therefor.

Modified Example 12

The liquid ejection apparatus is not limited to the printing apparatus 1. For example, the liquid ejection apparatus may be an apparatus of fabricating a color filter of a liquid crystal display or the like, an apparatus for forming an electrode of an organic EL display or EFD (face light emitting display) or the like, an ejection apparatus for ejecting a living body organic substance for fabricating a biochip, a fabricating apparatus for a fine pipet or the like. Further, various kinds of an ink jet type, a thermally transcribing type or the like may be adopted for the printing apparatus 1.

Second Embodiment

An explanation will be given of second embodiment of a pressurization apparatus, a liquid ejection apparatus and a flow path structure of a pressurizing pump embodying the invention in reference to FIG. 17 through FIG. 20 as follows.

Figure 17:
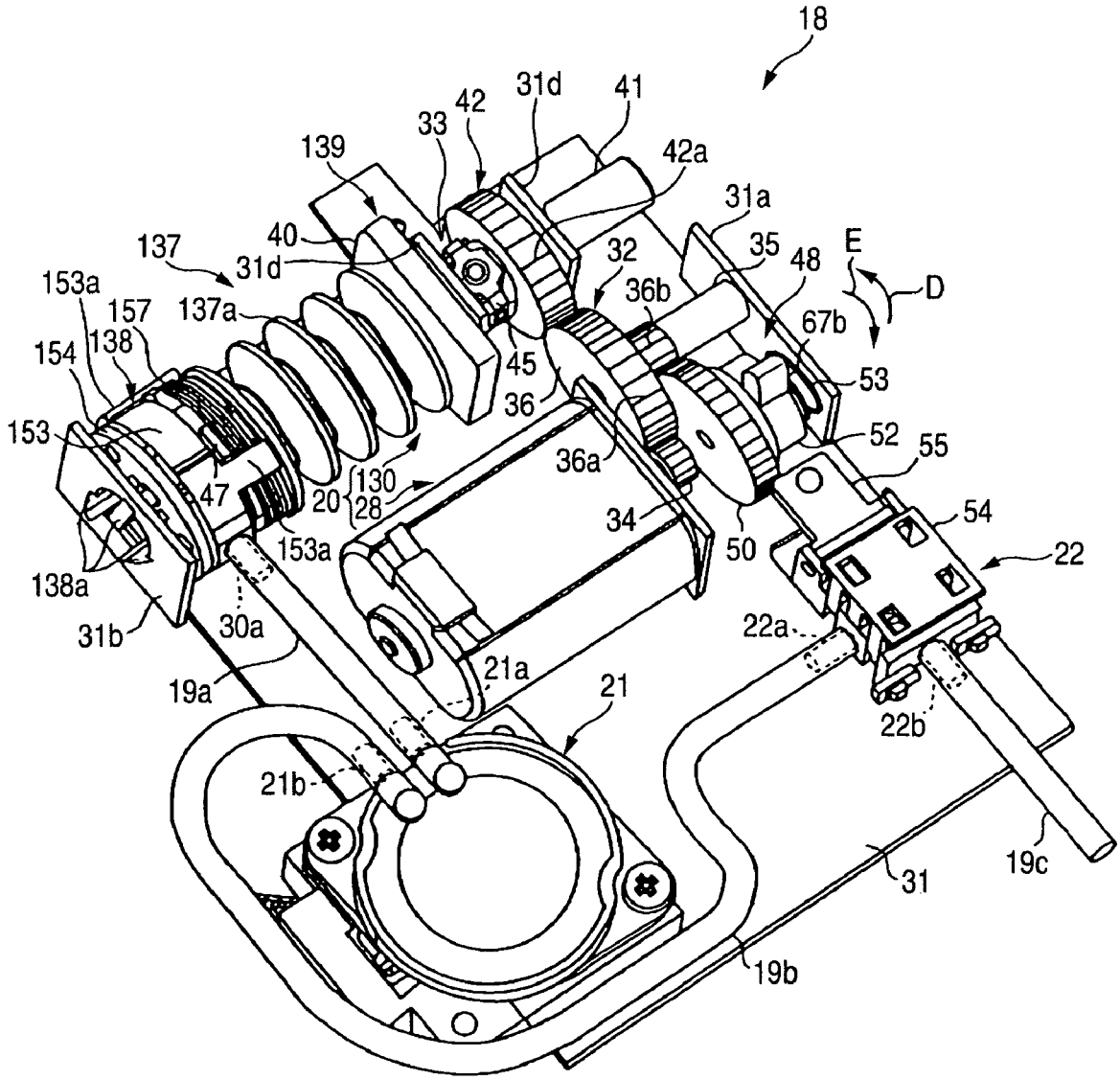
FIG. 17 is a perspective view of a pressurizing unit for delivering pressurizing air to an ink cartridge in second embodiment.
Figure 18:
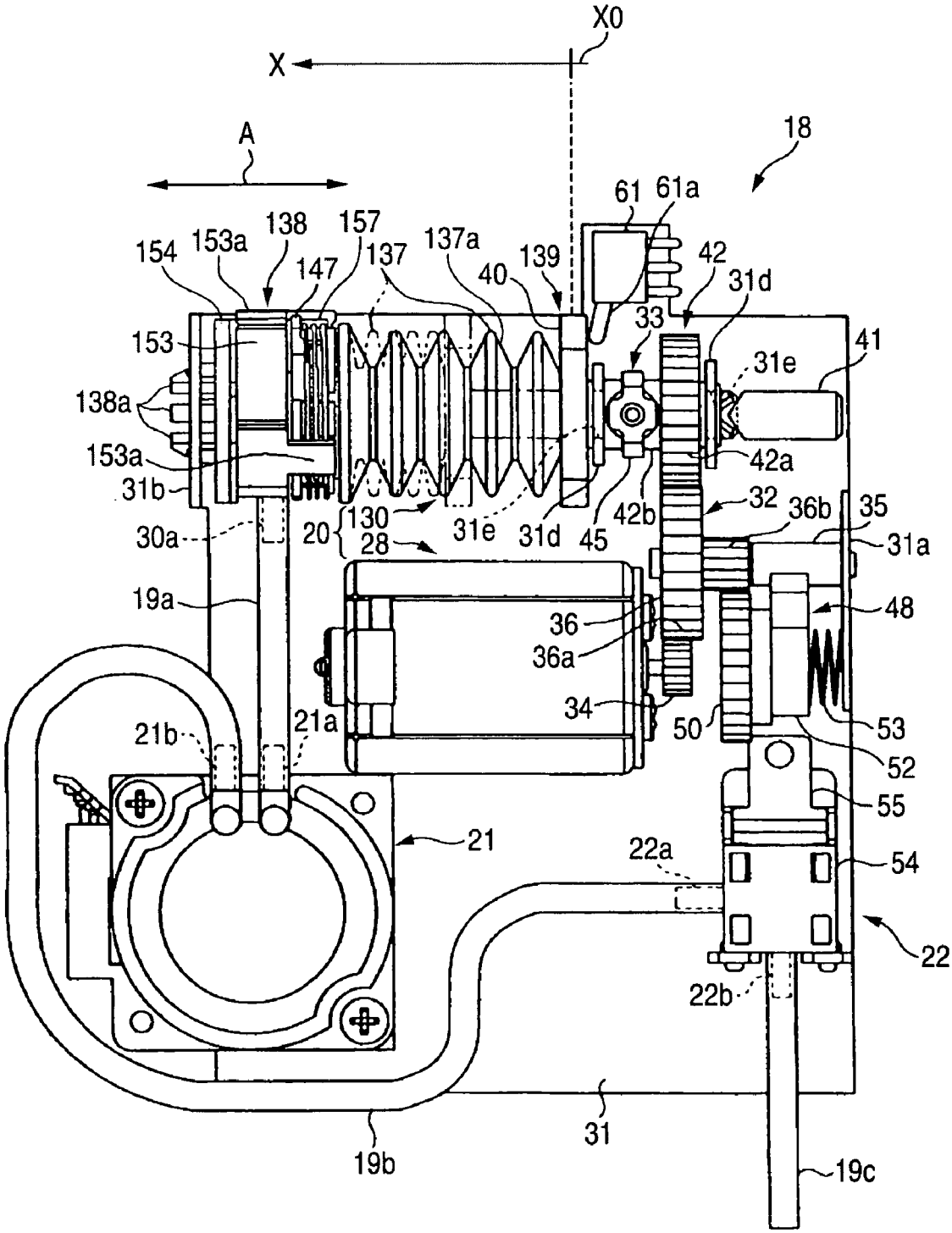
FIG. 18 is a plane view of the pressurizing unit for delivering pressurizing air to the ink cartridge.

As shown in FIGS. 17 and 18, the pump portion 130 is provided with a compressing portion 137 having the pump chamber 29 at inside thereof and a seat portion 138 attached to an end portion of the compressing portion 137. The compressing portion 137 includes a diaphragm (bellows) 137*a* and the diaphragm 137*a* is fabricated by, for example, blow forming or the like. The diaphragm 137*a* is capable of being expanded and contracted in a longitudinal direction (arrow mark A direction shown in FIG. 18) by constituting a drive source by the pump motor 28 and a volume of the pump chamber 29 is increased and reduced in accordance with the expanding and contracting operation. Further, the pump motor 28 corresponds to driving means (drive motor) and the gear mechanism 32 and the cam mechanism 33 constitute a converting mechanism.

An end face of the seat portion 138 is formed with a plurality (three in the example) of claw portions 138*a*. Meanwhile, the attaching plate 31 is folded to form with a holding wall 31*b* connected vertically from the bottom wall of the attaching plate 31 at a position opposed to an end face of the seat portion 138. A center portion of the holding wall 31*b* is formed with a locking hole 31*c* in a cylindrical shape. The pump portion 130 is fixed to the attaching plate 31 at a base end side (that is, a side of the seat portion 138) thereof by locking the claw portion 138*a* by the locking hole 31*c*. Other end of the diaphragm 137*a* is attached with a pressing member 139 for expanding and contracting the diaphragm 137*a* by linearly reciprocating to move based on a rotational movement of the pump motor 28.

Meanwhile, an end of the diaphragm 137*a* is formed with an engaging portion (refer to FIG. 19 and FIG. 20) by a shape matching the containing groove 40*b* (FIG. 6). The engaging portion 137*b* is brought into a state of being projected from an end portion (end face) of the diaphragm 137*a* and an outer side thereof is formed in a shape of a step constituting a diameter larger than that of an inner side to be able to engage with the containing groove 40*b* of the pressing member 139. Therefore, the diaphragm 137*a* is integrated to the pressing member 139 by fitting the engaging portion 137*b* from the side face 40*c* of the base portion 40 from the containing groove 40*b*.

Figure 19:
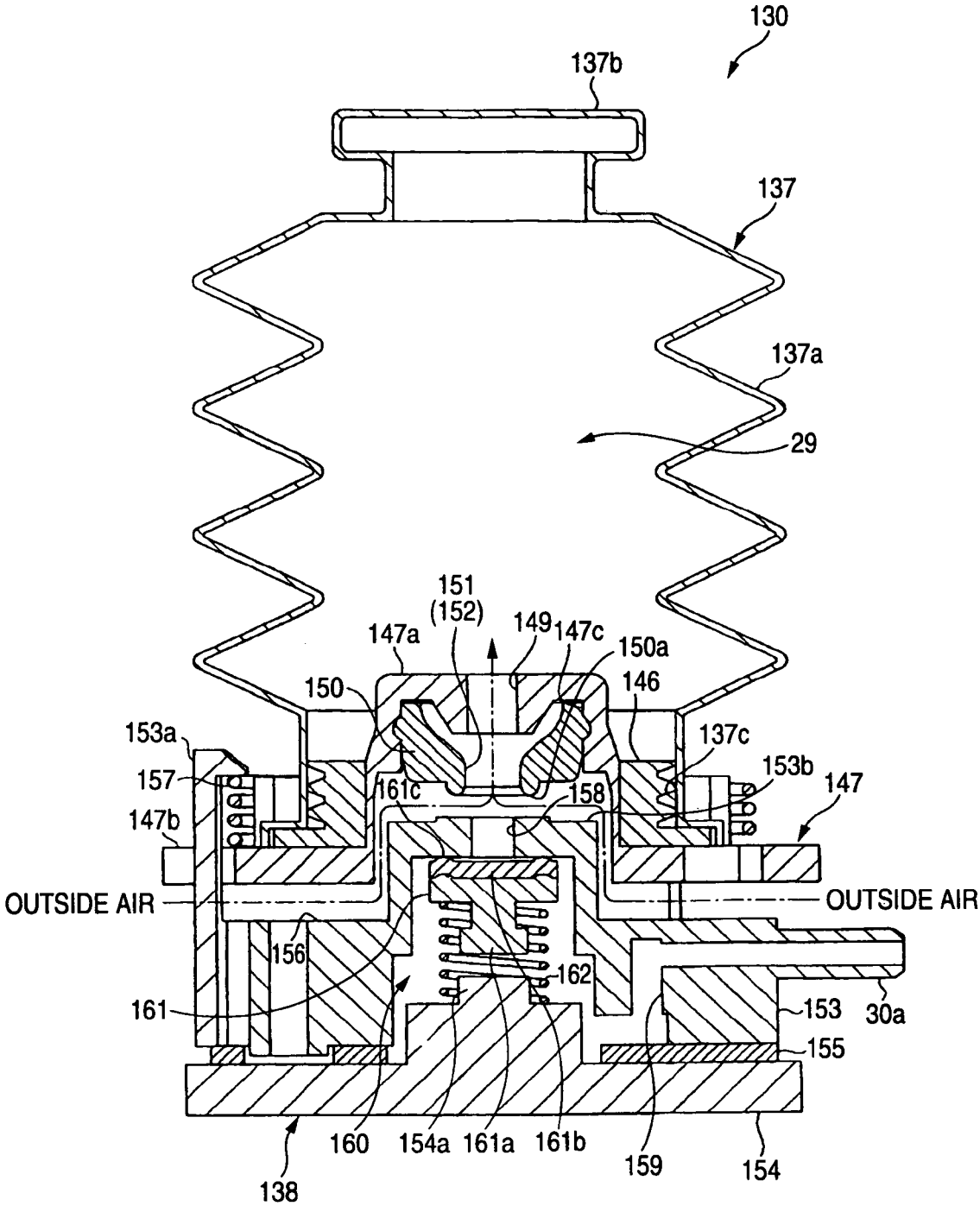
FIG. 19 is a side sectional view of a pump portion in a sucking state.
Figure 20:
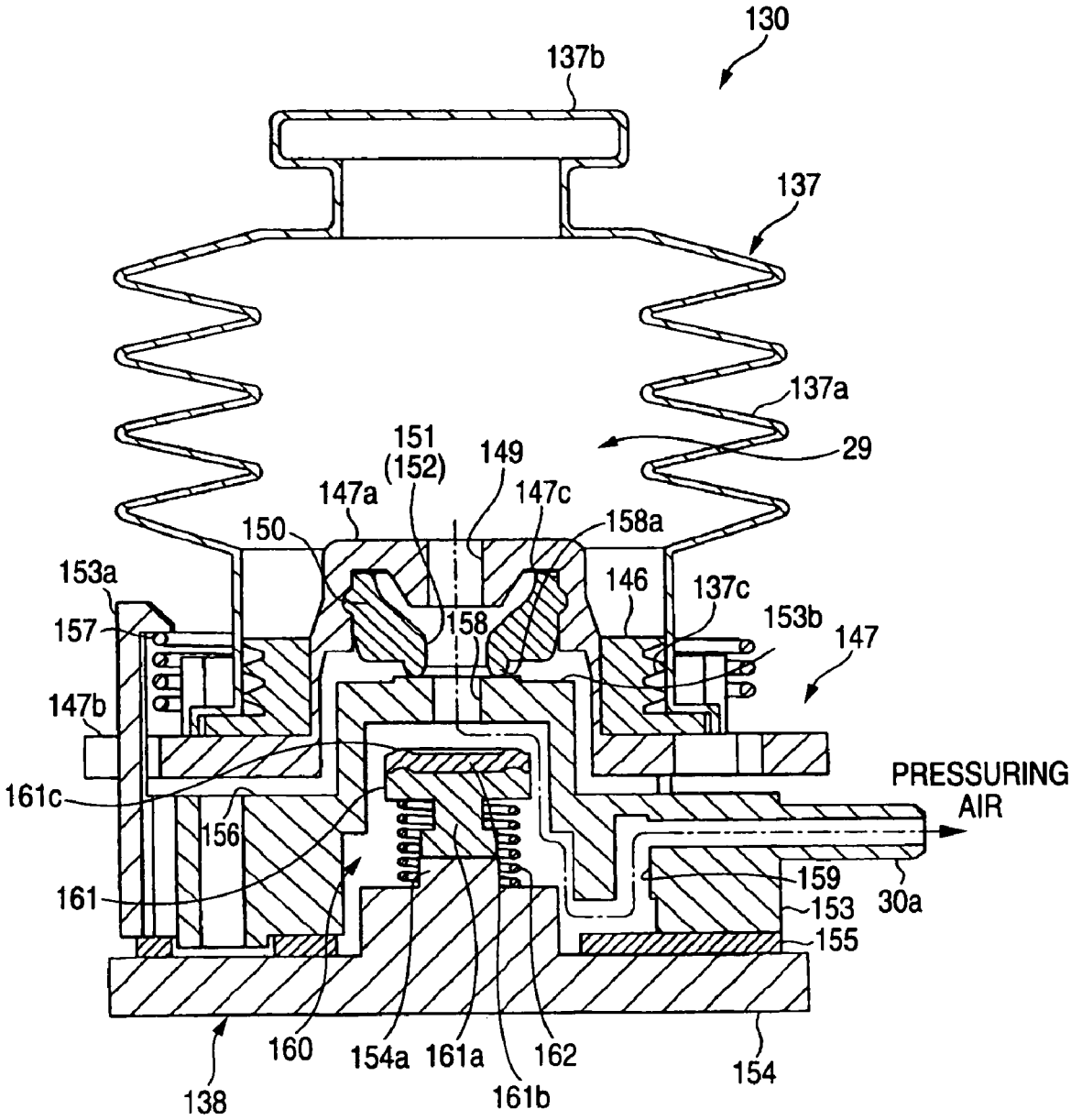
FIG. 20 is a side sectional view of the pump portion in a discharging state.

FIG. 19 is a side sectional view of the pump portion 130 in a sucking state and FIG. 20 is a side sectional view of the pump portion 130 in a discharging state. Other end (that is, an end portion on a side opposed to the engaging portion 137*b*) of the diaphragm 137*a* is formed with an opening portion 137*c* and the opening portion 137*c* is attached with a first lid member 147 via a first seal member 146. The first lid member 147 is constituted by a shape including a first projected portion 147*a* disposed at a center thereof and a flat plate portion 147*b* present to surround a surrounding of the first projected portion 147*a*. The first lid member 147 is attached to the diaphragm 137*a* in a state of directing the first projected portion 147*a* to the side of the pump chamber 29.

The first seal member 146 comprises rubber or the like as a material thereof and is formed in a ring-like shape to seal a total periphery of the opening portion 137*c* of the diaphragm 137*a*. The first seal member 146 is interposed between an outer face of the first projected portion 137*a* and an opening peripheral edge of the opening portion 137*c*, thereby, the first lid member 147 is brought into a state of being prevented from drawing off from the diaphragm 137*a*. Further, a center of the first projected portion 147*a* is penetrated with a through hole 149 for communicating inside and outside of the diaphragm 137*a*.

Further, at a bottom face (a lower face in FIG. 19 and FIG. 20) of the first lid member 147, and a recess portion 147*c* produced by forming the first projected portion 147*a* is attached with a second seal member 150 by tight fitting. The second seal member 150 comprises, for example, rubber or the like as a material thereof and includes a diffuser hole 151 an inner diameter of which is reduced in a lower direction from above. The second seal member 150 is attached to the first lid member 147 in a state of communicating the through hole 151 to the through hole 149. A lower face of the second seal member 150 is formed with a first close contact portion 150*a* in a ring-like shape projected to a lower side to surround the diffuser hole 151. Further, the second seal member 150 corresponds to a seal member.

By the above-described constitution, the pump chamber 29 is constituted by a space surrounded by the diaphragm 137*a*, the first seal member 146, the first lid member 147 and the second seal member 150. Further, the diffuser hole 151 constitutes a suction hole 152 for drawing air into the pump chamber 29 since the pump chamber 29 can be communicated to outside only by way of the diffuser hole 151. Further, the second seal member 150 corresponds to a seal member and the compressing portion 137 is constituted by the diaphragm 137*a*, the first seal member 146 and the first lid member 147.

The seat portion 138 is provided with a valve frame 153 corresponding to a main body portion of the seat portion 138, a second lid member 154 for covering an opening portion of the valve frame 153, and a third seal member 155 for sealing an interval between the valve frame 153 and the second lid member 154. An end edge in a diameter direction of the valve frame 153 is formed with a plurality (only one thereof is illustrated in FIG. 19 and FIG. 20) of locking projected pieces 153*a* extended to the side of the compressing portion 137. The compressing portion 137 is integrated to the seat portion 138 by being contained to inner sides of the locking projected pieces 153*a* in a state of being able to move relatively in an axial direction (up and down direction of FIG. 19 and FIG. 20). A space is produced between the compressing portion 137 and the seat portion 138 over entire regions of faces thereof opposed to each other and the space functions as a suction path 156. Further, the suction port 152 corresponds to a suction inlet and the suction path 156 corresponds to the suction path.

A structure of suction of the pump portion 130 is as follows. That is, as shown by FIG. 19, when suction operation is executed by expanding the diaphragm 137*a* by driving the pump motor 28, the compressing portion 137 is separated from the seat portion 138 and the first close contact portion 150*a* of the second seal member 150 is separated from the seat portion 138 to bring about a state of communicating the suction port 152 and the suction path 156. Meanwhile, as shown by FIG. 20, when suction operation is executed by contracting the diaphragm 137*a* by driving the pump motor 28, the compressing portion 137 becomes proximate to the seat portion 138, the first close contact portion 150*a* of the second seal member 150 is brought into close contact with the seat portion 138 to bring about a state of cutting communication between the suction port 152 and the suction path 156.

An interval between the flat plate portion 147*b* and the locking projected piece 153*a* is interposed with a spring (hereinafter, described as return spring) 157 for urging the diaphragm 137*a* to a side of expanding the diaphragm 137*a*. By the integrating structure, the compressing portion 137 is held in a state of being prevented from being drawn out from the seat portion 137 although the compressing portion 137 can be moved relative to the seat portion 137. Further, when the pressurizing pump 20 is not operated, the diaphragm 137*a* is brought into a maximally expanded state by an urge force of the return spring 157. Therefore, the diaphragm 137*a* is not left for a long period of time while staying to be contracted and the diaphragm 137*a* is difficult to be deformed by creep. Further, the return spring 157 corresponds to second urging means.

A center portion of the valve frame 153 is formed with a second projected portion 153*b* contained in the recess portion 147*c* of the compressing portion 137. A center of the second projected portion 153*b* is formed with a discharge port 158 for discharging pressurizing air in the pump chamber 29 to outside of the pump chamber 29. The discharge port 158 is disposed at a position opposed to the suction port 152, that is, is brought into a state of being disposed on the same axis. Inside of the seat portion 138 is penetrated with a discharge path 159 constituting a way of passing pressurizing air flowing out from the discharge port 158. The third seal member 155 comprises, for example, rubber, packing or the like to ensure sealing performance of the discharge path 159. Further, the discharge port 158 corresponds to a delivery port and the discharge path 159 corresponds to a delivery path.

The discharge path 159 is provided with a discharge side check valve mechanism 160 brought into a closed state in sucking operation and is brought into an opened state in delivery operation. Explaining the mechanism, a valve member (delivery valve) 161 capable of opening and closing the discharge port 158 is interposed in the discharge path 159. The valve member 161 is integrally provided with a support member 161*a* constituting a main body portion and a contact member 161*b* brought into contact with a peripheral edge of the discharge port 158. The contact member 161*b* comprises, for example, rubber or the like as a material thereof and a second close contact portion 161*c* in a ring-like shape projected to the side of the discharge port 158 is formed over an entire region of a peripheral edge of the contact member 161*b*. Further, the discharge side check valve mechanism 160 corresponds to a delivery side check valve mechanism.

An interval between the valve member 161 and the second lid member 154 is interposed with a spring (hereinafter, described as valve urging spring) 162 for urging the valve member 161 to the side of the discharge port 158. The valve urging spring 162 is fixedly attached to the seat portion 138 by locking one end thereof by the support member 161*a* and locking other end thereof by a spring receive 154*a* of the second lid member 154. An urging force of the valve urging spring 162 is set to a value by which the valve member 161 is not brought into an opened state when impacting the valve member 161 or changing an attitude position thereof. Further, the valve urging spring 162 corresponds to urging means.

Successively, sucking operation and discharging operation of the pressurizing pump 20 will be explained as follows. First, when the diaphragm 137*a* is expanded as shown by FIG. 19 based on rotation of the pump motor 28, the compressing portion 137 is moved to a side of separating from the seat portion 138. Then, there is brought about a state in which the first close contact portion 150*a* of the second member 150 is separated from the seat portion 138 to open the suction port 152, the pump portion 130 is brought into a suction state and outside air is delivered into the pump chamber 29 by way of the suction path 156 and the suction port 152. At this occasion, the suction side check valve mechanism 160 is brought into a closed state by bringing the second close contact portion 161*c* of the valve member 161 into contact with the valve frame 153 to bring about a state in which sucked outside air is prevented from being leaked out to the discharge path 159.

On the other hand, when the diaphragm 137*a* is contracted as shown by FIG. 20, the compressing portion 137 is moved to be proximate to the seat portion 138 by a pressing force in the pump chamber 29. Then, there is brought about a state in which the first close contact portion 150*a* of the second seal member 150 is brought into close contact with the seat portion 138 to bring about a state of closing the suction port 152 to bring about a state of blocking the suction port 156. At this occasion, the valve member 161 is moved to a lower side against an urging force of the valve urging spring 162 by pressurizing air in the pump chamber 29 and the second close contact portion 161*c* is separated from the valve frame 153 to bring about a state of opening the discharge side check valve mechanism 160. Therefore, the pump portion 130 is brought into a discharging state and pressurizing air in the pump chamber 29 is discharged from the discharge port 158. By repeating suction and discharge by the pressurizing pump 20, the pressure of pressurizing air is increased.

Pressurizing operation will be explained as follows. Normally, the pressurizing pump 20 is stopped in a state of maximally expanding the diaphragm 137*a* based on a result of detection of the home detector 61 and therefore, before starting the pressurizing operation, the diaphragm 137*a* is brought into a maximally expanded state as shown by FIG. 19. At this occasion, by pulling the diaphragm 137*a* by the pressing member 139, the compressing portion 137 is separated from the seat portion 138 to bring about a state of opening the suction port 152. Therefore, outside air flows to the pump chamber 29 by way of the suction path 156 and the suction port 152 to bring about a state of filing inside of the pump chamber 29 with outside air.

Successively, when the pump motor 28 starts to be rotated regularly and the diaphragm 137*a* is started to be contracted, as shown by FIG. 20, the compressing portion 137 is moved to the side of the seat portion 138 by the pressing force in the pump chamber 29 to bring about a state of bringing the second seal member 150 into close contact with the seat portion 138. Thereby, the suction port 152 and the suction path 156 are not communicated with each other and the discharge port 158 opposed to the suction port 152 constitutes an outlet of the pump chamber 29. At this occasion, the valve member 161 is pressed by pressurizing air of the pump chamber 29 to bring about a state of opening the discharge side check valve mechanism 160 and pressurizing air in the pump chamber 29 is discharged from the discharge port 158 to a side of the ink cartridge 4.

When the diaphragm 137*a* is maximally contracted, the pressing member 139 which has been moved forward starts to move rearward, thereby, the diaphragm 137*a* starts to be expanded again. Then, as shown by FIG. 19, the diaphragm 137*a* is pulled by the pressing member 139, the compressing portion 137 starts to be separated from the seat portion 138, and the second seal member 150 is separated from the seat portion 138 to bring about a state of opening the suction port 152. At this occasion, the valve member 161 is pressed to the closed side by pressure of the discharge path 159 to bring about a state of closing the discharge side check valve mechanism 160. Therefore, the pump portion 130 is brought into the suction state and outside air is delivered into the pump chamber 29. By repeating suction and discharge in this way, pressurizing air is supplied to the ink cartridge 4 by way of the air supply tube 19.

Meanwhile, depending on a state of operating the printing apparatus 1, there is also conceivable a case of excessively increasing the pressure of pressurizing air in the air supply tube 19 against intention. As a cause for increasing the pressure excessively, for example, there is a temperature rise of the printing apparatus 1 per se by being used for a long period of time. ASIC 81 determines that pressurizing air is excessively increased when the calculated pressure value P of pressurizing air becomes not less than the threshold Pb. Therefore, ASIC 81 executes pressurization releasing operation for lowering a pressure in the air supply tube 19, that is, operation of opening the atmospheric release valve 22.

Explaining pressurization releasing operation, ASIC 81 rotates the pump motor 28 inversely when it is determined that the pressure value P of pressurizing air exceeds the threshold Pb. Therefore, in accordance with inverse rotation of the pump motor 28, the driven part 52 starts to be rotated from the state shown in FIG. 10 in an arrow mark E direction of the drawing by way of the friction clutch mechanism 48. At this occasion, when the driven part 52 is rotated regularly, as shown by FIG. 11, the pressing portion 52*b* of the driven part 52 moves down the valve opening lever 55 to bring about a state of opening the atmospheric release valve 22. Therefore, pressurizing air in the air supply tube 19 is discharged to outside to resolve an excessively pressurized state.

According to the example, the suction port 152 and the discharge port 158 are arranged at portions opposed to each other along an axis center of the pump portion 130. Therefore, in comparison with a pressurizing pump in which a suction port and a discharge port are present on a plane orthogonal to the axis center of the pump portion 130, according to the constitution of the example, a size in a diameter direction is restrained to be small and therefore, a size in the diameter direction of the pump portion 130 and therefore, the pressurizing pump 20 can be downsized. Further, since there is used the pump portion 130 in which the suction path 156 is communicated with or not communicated with the suction port 152 by moving the compressing portion 137 relative to the seat portion 138 to be brought into close contact with or not brought into close contact with the second seal member 150 and therefore, a structure per se of the pump portion 150 in which the suction port 152 and the discharge port 158 are opposed to each other is simplified.

Further, since the discharge side check valve mechanism 160 is provided on the discharge path 159, pressurizing air which has been temporarily discharged from the discharge port 158 does not flow back to the side of the pump chamber 29. Therefore, there is a constructed a constitution of increasing the pressurizing force of the diaphragm 137*a* in accordance with movement of expanding and contracting the diaphragm 36*a* and therefore, even when the diaphragm 137*a* is downsized, the sufficient pressurizing force can be achieved, which further contributes to small-sized formation of the pressurizing pump 20 and therefore, the printing apparatus 1.

Therefore, according to the constitution of the second embodiment, the following effects can be achieved.

(1) Since the suction port 152 and the discharge port 158 are arranged at positions opposed to each other along the axis center of the pump portion 130, a size in the diameter direction of the pump portion 130 and therefore, the pressurizing air pump 20 can be downsized.

(2) The discharge side check valve mechanism 160 is provided on the discharge path 159. Therefore, there is constructed the constitution of increasing the pressurizing force of the diaphragm 137*a* in accordance with movement of expanding and contracting the diaphragm 137*a* and therefore, even when the diaphragm 137*a* is downsized, the sufficient pressurizing force can be achieved, which further contributes to downsize the pressurizing pump 20 and therefore, the printing apparatus 1.

(3) The valve member 161 of the discharge check valve mechanism 160 is always urged to a closed side by the valve urging spring 162 and therefore, for example, even when the pressurizing pump 20 (pressurizing unit 18) is impacted or even when an attitude position of the pressurizing pump 20 (pressurizing unit 18) is changed, it is difficult to bring about a state of opening the valve member 161 unintentionally. Therefore, it is difficult to bring about a drawback in which the discharge side check valve mechanism 160 which is to be in an opened state is brought a closed state and certainly of operation of opening and closing the valve member 161 can be promoted.

(4) The pump portion 130 is provided with the return spring 157 for urging the diaphragm 137*a* to the maximally expanded state. Therefore, the diaphragm 137*a* is not left in the contract state for a long period of time and therefore, it is difficult to deform the diaphragm 137*a* by creep and it is difficult to deteriorate the pressurizing pump 20 by pressure.

Modified Example 3

The second seal member 150 may be attached to the seat portion 138 in place of the compressing portion 137.

Modified Example 4

The discharge side check valve mechanism 160 is not limited to the constitution of urging the valve member 161 by the valve urging spring 162 but may be constituted by a simple tongue piece.

Modified Example 5

The return spring 157 for urging the diaphragm 137*a* to the maximally expanded state may not necessarily be present but may be omitted.

Modified Example 6

The pump motor 28 is not limited to the DC motor but an AC motor may be used thererfor.

Next, the technical thought which can be grasped from the above-described embodiments and other examples will additionally be described below.

(1) In the invention, there is provided the position detecting device (61) for detecting whether the pressing member is present at the home position constituting the position of starting to move the pressing member, the control unit starts to determine the position of the pressing member based on the detected value from the position detecting device after the pressure value becomes smaller than the first threshold in executing to release the pressure, and stops the drive motor when the pressing member reaches the home position.

(2) In the invention, the converting mechanism comprises the cam mechanism for converting the rotational movement of the drive motor into the linear reciprocating movement, and the gear mechanism for transmitting rotation of the drive motor to the cam mechanism, the gear mechanism transmits the rotational force of the drive motor to both of the converting mechanism and the valve mechanism, the cam mechanism is operated when the drive motor is rotated at least in one direction to make the pump portion execute the pressing operation and the valve mechanism is operated to be brought into the opened state only when the drive motor is rotated in other direction. In this case, the gear mechanism is shared by the cam mechanism and the valve mechanism and therefore, a reduction in a number of parts and small-sized formation of the apparatus can be achieved.

(3) In the invention, there is provided a pressurization releasing controlling unit for executing the pressurization releasing operation by bringing the valve mechanism into the opened state by rotating the drive motor in other direction when the pressure value becomes not less than the first threshold constituting the excessive pressure value, the control unit starts to determine the position of the pressurizing member based on the detected value from the position detecting device after the predetermined time period has elapsed after the pressure value becomes lower than a value lower than the first threshold in executing the pressurization releasing operation by the pressurization releasing controlling unit and when the pressing member reaches the home position, the drive motor is stopped.

(4) In the invention, the pump portion is constituted by the diaphragm (37) provided with the check valve (46) allowing only to suck the fluid from outside at the suction port (38*b*) and provided with the check valve (47) allowing only to discharge the pressurizing fluid at the discharge port (38*c*).

(5) In the invention, the pump portion is constituted by the cylinder (81) provided with a check valve allowing only to suck the fluid from outside at a suction port and provided with a check valve allowing only to discharge the pressurizing fluid at a discharge port.

In the invention, the valve mechanism is provided with the lever member (55) pivotally supported by the valve main body (54), the valve element (59) integrally formed with the lever member, the valve hole (56) opened and closed by the valve element, and the urging member (60) for urging the lever member in the closing direction, when the drive motor is rotated in one direction, the valve element is brought into the closed state by urging the lever member to the side of the valve hole by the urging force of the urging member, when the drive motor is rotated in other direction, the valve mechanism is operated to pivot the lever member, and the valve element is brought into the opened state.

(6) In the invention, when the pressure value of the pressurizing fluid staying in the valve chamber (54*b*) of the valve mechanism per se becomes not less than the second threshold set to be a value larger than the first threshold, the valve element is automatically brought into the opened state.

(7) In the invention, the valve mechanism is provided with the friction clutch mechanism in which when the drive motor is rotated in other direction, the driven part (52) is rotated along with the drive motor via the friction clutch and the pressing portion (52*b*) of the driven member is brought into contact with the lever member to pivot the lever member.

(8) In the invention, the speed reduction ratio of the friction clutch is set to be larger than the speed reduction ratio of the gear mechanism (36, 42) for transmitting rotation of the drive motor to the converting mechanism.

(9) In the invention, there is provided a pressure detector for detecting a pressure of pressurizing fluid flowing in the fluid path tube, the control unit calculates a pressure value based on a detected value of the pressure detector and release a pressurization by bringing the valve mechanism into the opened state by rotating the drive motor in other direction and the pressure value becomes not less than the first threshold (Pb).

(10) In the invention, the valve mechanism comprises the lever member (55) pivotally supported by the valve main body (54), the valve (59) integrally formed with the lever member, the valve hole (56) opened and closed by the valve, and the urging member (60) for urging the lever member in a closing direction, when the drive motor is rotated in one direction, the lever member is urged to a side of the valve hole by the urging force of the urging member to bring about the state of closing the valve and when the drive motor is rotated in other direction, the valve mechanism is operated to pivot the lever member to bring about the state of opening the valve.

(11) In the invention, when the pressure value of the pressurizing fluid staying in the valve chamber of the valve mechanism per se becomes not less than the second threshold (Pc) set to a value higher than the first threshold, the valve is automatically brought into an opened state.

(12) In the invention, the valve mechanism comprises the friction clutch mechanism (48) in which when the drive motor is rotated in other direction, the drive part (52) is rotated along with the drive motor via the friction clutch and the pressing portion (52*b*) of the driven part is brought into contact with the lever member to pivot the lever member.

(13) In the invention, the speed reduction ratio of the friction clutch is set to be larger than the speed reduction ratio of the gear mechanism (36, 42) for transmitting rotation of the drive motor to the converting mechanism.

(14) In the invention, a seal member is attached to the compressing portion and the hole (151) penetrating the seal member serves also as the suction port.

What is claimed is:

1. A pressurizing pump device comprising:

a drive motor for driving a pump;

a pump portion for discharging a pressurizing fluid from a pump chamber by increasing and reducing a volume of the pump chamber by linearly reciprocating to move a pressing member for pressing the pump chamber;

a converting mechanism converting a rotational movement of the drive motor into a linear reciprocating movement to thereby linearly reciprocate the pressing member; and a valve mechanism provided in a fluid path tube in which the pressurizing fluid flows and capable of releasing a pressurization by the pressurizing fluid;

wherein a control unit executes a pressurizing operation of the pump portion where a rotation of the drive motor in one direction is converted into the linear reciprocating movement of the pressing member by the converting mechanism, and the pressurization is releasable by bringing the valve mechanism into an opened state by rotating the drive motor in another direction.

2. The pressurizing pump device according to claim 1, further comprising:

a pressure detector for detecting a pressure of the pressurizing fluid flowing in the fluid path tube;

wherein the control unit calculates a pressure value based on a detected value of the pressure detector and releases the pressurization by bringing the valve mechanism into the opened state when the pressure value becomes not less than a first threshold.

3. The pressurizing pump device according to claim 1, wherein the pump portion includes a diaphragm provided with a check valve allowing only to suck the fluid from outside at a suction port and a check valve allowing only to discharge the fluid at a discharge port.

4. The pressurizing pump device according to claim 1, wherein the pump portion includes a cylinder provided with a check valve allowing only to suck the fluid from outside at a suction port and a check valve allowing only to discharge the pressurizing fluid at a discharge port.

5. The pressurizing pump according to claim 1, wherein the valve mechanism includes a lever member pivotally supported by a valve main body, a valve element integrally formed with the lever member, a valve hole opened and closed by the valve element, and an urging member for urging the lever member in a direction of opening the valve element, when the drive motor is rotated in said one direction, the valve element is brought into a closed state with by urging the lever member to the valve hole by an urge force of the urging member, and when the drive motor is rotated in said another direction, the lever member is pivotally actuated by the valve mechanism and the valve element is brought into the opened state.

6. The pressurizing pump device according to claim 1, wherein a valve element of the valve mechanism is brought into an opened state when a pressure value of the pressurizing fluid in a valve chamber of the valve mechanism becomes not less than a second threshold larger than the first threshold.

7. The pressurizing pump device according to claim 5, wherein the valve mechanism includes a friction clutch mechanism for pivoting the lever member by bringing a pressing portion of a driven part into contact with the lever member by rotating the driven part along with the drive motor through the friction clutch when the drive motor is rotated in said another direction.

8. The pressurizing pump device according to claim 7, wherein a speed reduction ratio of the friction clutch is set to be larger than a speed reduction ratio of a gear mechanism for transmitting rotation of the drive motor to the converting mechanism.

9. A liquid ejection apparatus comprising:

a liquid cartridge for discharging a liquid by expanding and contracting a liquid containing portion to an inner portion thereof by being supplied with a pressurizing fluid to a space of the inner portion;

a liquid ejection head capable of ejecting the fluid;

a liquid path tube for guiding the liquid from the liquid cartridge to the liquid ejection head;

a pressurizing pump device for supplying a pressurizing fluid into the liquid cartridge; and a fluid path tube for guiding the pressurizing fluid into the liquid cartridge;

wherein the pressurizing pump device comprises:

a drive motor for driving a pump;

a pump portion for discharging a pressurizing fluid from a pump chamber by increasing and reducing a volume of the pump chamber by linearly reciprocating to move a pressing member for pressing the pump chamber;

a converting mechanism converting a rotational movement of the drive motor into a linear reciprocating movement to thereby linearly reciprocate the pressing member; and a valve mechanism provided in a fluid path tube in which the pressurizing fluid flows and capable of releasing a pressurization by the pressurizing fluid;

wherein a control unit executes a pressurizing operation of the pump portion where a rotation of the drive motor in one direction is converted into the linear reciprocating movement of the pressing member by the converting mechanism, and the pressurization is releasable by bringing the valve mechanism into an opened state by rotating the drive motor in another direction.

10. A method of releasing a pressurization of a pressurizing fluid, using a pressurizing pump device comprising a drive motor for driving a pump;

a pump portion for discharging a pressurizing fluid from a pump chamber by increasing and reducing a volume of the pump chamber by linearly reciprocating to move a pressing member for pressing the pump chamber;

a converting mechanism converting a rotational movement of the drive motor into a linear reciprocating movement to thereby linearly reciprocate the pressing member;

a valve mechanism provided in a fluid path tube in which the pressurizing fluid flows and capable of releasing a pressurization by the pressurizing fluid; and a control unit for controlling the drive motor, wherein said control unit executes:

a pressurizing operation of the pump portion where a rotation of the drive motor in one direction is converted into the linear reciprocating movement of the pressing member by the converting mechanism, and a pressurization releasing operation of the pump portion where the pressurization is released by bringing the valve mechanism into an opened state by rotating the drive motor in another direction.

11. A pressurizing pump device comprising:

a drive motor for driving a pump;

a pump portion for discharging a pressurizing fluid from a pump chamber by increasing and reducing a volume of the pump chamber by linearly reciprocating to move a pressing member for pressing the pump chamber;

a converting mechanism for converting a rotational movement of the drive motor into a linear reciprocating movement of the pressing member when the drive motor is rotated in one direction; and a valve mechanism provided in a fluid path tube in which the pressuring fluid flows and capable of releasing a pressurization by the pressurizing fluid by being brought into an opened state when the drive motor is rotated in another direction;

a pressure detector for detecting a pressure of the pressurizing fluid flowing in the fluid path tube;

a position detecting device for detecting a home position of the pressing member at which the pressing member starts to move; and a calculating unit for calculating a pressure value of the pressurizing fluid based on a detected value of the pressure detector;

wherein a control unit starts to monitor a position of the pressurizing member based on a detected value provided from the position detecting device when a predetermined time period is elapsed after a termination of a pressurizing operation of the pump portion is determined based on the pressure value calculated by the calculating unit, and said control unit stops the drive motor when the pressing member reaches the home position.

12. The pressurizing pump device according to claim 11, further comprising:

a pressurizing operation controlling unit that starts to drive the pump portion by rotating the drive motor in said one direction, stops driving the pump portion when the pressure value becomes not less than a set value, and drives the pump portion again when the pressure value becomes lower than the set pressure so that the pressurizing operation is repeated;

wherein the control unit starts to monitor a position of the pressurizing member based on a detected value provided from the position detecting device when a predetermined time period is elapsed after the pressure value has become not less than the set value during the pressurizing operation by the pressurizing operation controlling unit, and said control unit stops driving the pump portion by stopping the drive motor when the pressurizing member reaches the home position.

13. The pressurizing pump device according to claim 11, further comprising:

a pressurization releasing controlling unit that executes a pressurization releasing operation by bringing the valve mechanism into an opened state by rotating the drive motor in said another direction when the pressurization releasing operation is determined to be executed based on the detected value of the pressure detector or when an instruction for operation is input;

wherein the control unit starts to monitor a position of the pressing member based on a detected value from the position detecting device after the pressure value becomes lower than a predetermined threshold during the pressurization releasing operation by the pressurization releasing controlling unit, and said control unit stops the drive motor when the pressing member reaches the home position.

14. The pressurizing pump device according to claim 11, wherein said control unit monitors a position of the pressing member based on a detected value from the position detecting device when a predetermined time period is elapsed after the pressure value has become lower than the predetermined threshold during the pressurization releasing operation by the pressurization releasing controlling unit, and said control unit stops the drive motor when the pressurizing member reaches the home position.

15. The pressurizing pump device according to claim 11, wherein the predetermined time period is not less than a time period necessary for reciprocating the pressing member at least by one reciprocation.

16. A liquid ejection apparatus comprising:

a liquid cartridge for discharging a liquid by expanding and contracting a liquid containing portion to an inner portion thereof by being supplied with a pressurizing fluid to a space of the inner portion;

a liquid ejection head capable of ejecting the fluid;

a liquid path tube for guiding the liquid from the liquid cartridge to the liquid ejection head;

a pressurizing pump device for supplying a pressurizing fluid into the liquid cartridge; and a fluid path tube for guiding the pressurizing fluid into the liquid cartridge;

wherein the pressurizing pump device comprises:

a drive motor for driving a pump;

a pump portion for discharging a pressurizing fluid from a pump chamber by increasing and reducing a volume of the pump chamber by linearly reciprocating to move a pressing member for pressing the pump chamber;

a converting mechanism for converting a rotational movement of the drive motor into a linear reciprocating movement of the pressing member when the drive motor is rotated in one direction; and a valve mechanism provided in a fluid path tube in which the pressuring fluid flows and capable of releasing a pressurization by the pressurizing fluid by being brought into an opened state when the drive motor is rotated in another direction;

a pressure detector for detecting a pressure of the pressurizing fluid flowing in the fluid path tube;

a position detecting device for detecting a home position of the pressing member at which the pressing member starts to move; and a calculating unit for calculating a pressure value of the pressurizing fluid based on a detected value of the pressure detector;

wherein a control unit starts to monitor a position of the pressurizing member based on a detected value provided from the position detecting device when a predetermined time period is elapsed after a termination of a pressurizing operation of the pump portion is determined based on the pressure value calculated by the calculating unit and said control unit stops the drive motor when the pressing member reaches the home position.

17. A method of stopping driving a pressurization in a pressurizing pump device comprising a pressurizing pump device comprising a drive motor for driving a pump;

a pump portion for discharging a pressurizing fluid from a pump chamber by increasing and reducing a volume of the pump chamber by linearly reciprocating to move a pressing member for pressing the pump chamber;

a converting mechanism converting a rotational movement of the drive motor into a linear reciprocating movement to thereby linearly reciprocate the pressing member;

a valve mechanism provided in a fluid path tube in which the pressurizing fluid flows and capable of releasing a pressurization by the pressurizing fluid; and a control unit for controlling the drive motor, wherein a pressure of the pressurizing fluid flowing in the fluid path tube is detected by a pressure detector, a home position of the pressing member at which the pressing member starts to move is detected by a position detecting device, and a pressure value of the pressurizing fluid is calculated by a calculating unit based on a detected value of the pressure detector; and the control unit starts to monitor a position of the pressing member based on a detected value provided from the position detecting device when a predetermined time period is elapsed after the control unit determines to stop the drive motor based on the pressure value calculated by the calculating unit and said controller stops the drive motor when the pressing member reaches the home position.

* * * * *